US007115810B2

(12) United States Patent
Ambrosino

(10) Patent No.: US 7,115,810 B2
(45) Date of Patent: Oct. 3, 2006

(54) PROGRAMMABLE/SEMI-PROGRAMMABLE PICKUP AND TRANSDUCER SWITCHING SYSTEM

(75) Inventor: Eric P. Ambrosino, Windsor, CT (US)

(73) Assignee: Ambrosonics, LLC, Windsor, CT (US)

( * ) Notice: Subject to any disclaimer, the term of this patent is extended or adjusted under 35 U.S.C. 154(b) by 0 days.

(21) Appl. No.: 11/179,638

(22) Filed: Jul. 13, 2005

(65) Prior Publication Data

US 2006/0011051 A1 Jan. 19, 2006

Related U.S. Application Data

(60) Provisional application No. 60/588,679, filed on Jul. 15, 2004.

(51) Int. Cl.
*G10H 1/18* (2006.01)
*G10H 3/12* (2006.01)

(52) U.S. Cl. ..... 84/742

(58) Field of Classification Search ..... 84/735, 84/737, 742

See application file for complete search history.

(56) References Cited

U.S. PATENT DOCUMENTS

| | | | | |
|---|---|---|---|---|
| 3,915,048 | A | 10/1975 | Stich | 84/1.14 |
| 4,080,867 | A | 3/1978 | Ratanangsu | 84/477 R |
| 4,175,462 | A | 11/1979 | Simon | 84/1.16 |
| 4,305,320 | A | 12/1981 | Peavey | 84/1.16 |
| 4,336,734 | A | 6/1982 | Polson | 84/1.01 |
| 4,339,979 | A | 7/1982 | Norman | 84/1.23 |
| 4,480,520 | A | 11/1984 | Gold | 84/1.16 |
| 4,658,690 | A | 4/1987 | Aitken et al. | 84/1.14 |
| 4,704,941 | A | 11/1987 | Reilly | 84/464 A |
| 4,711,149 | A | 12/1987 | Starr | 84/1.16 |
| 4,817,486 | A | 4/1989 | Saunders | 84/1.15 |
| 5,024,134 | A | 6/1991 | Uchiyama | 84/654 |
| 5,051,799 | A | 9/1991 | Paul et al. | 375/25 |
| 5,136,918 | A | 8/1992 | Riboloff | 84/723 |
| 5,136,919 | A | 8/1992 | Wolstein | 84/742 |
| 5,245,128 | A | 9/1993 | Araiza | 84/626 |
| 5,270,475 | A | 12/1993 | Weiss et al. | 84/603 |
| 5,311,806 | A | 5/1994 | Riboloff | 84/728 |
| 5,339,275 | A | 8/1994 | Hyatt | 365/45 |
| 5,700,966 | A | 12/1997 | LaMarra | 84/645 |
| 5,763,808 | A | 6/1998 | Thomson | 84/728 |
| 5,780,760 | A | 7/1998 | Riboloff | 84/726 |
| 5,789,689 | A | 8/1998 | Doidic et al. | 84/603 |
| 5,834,671 | A | 11/1998 | Phoenix | 84/645 |

(Continued)

FOREIGN PATENT DOCUMENTS

CA 2 372 014 A1 8/2003

(Continued)

OTHER PUBLICATIONS

B.B. King 'Little Lucille', http://www.gibson.com/products/gibson/hawk/LittleLucille.html [online], retrieved Jun. 11, 2004, two pages.

(Continued)

*Primary Examiner*—Jeffrey W Donels
(74) *Attorney, Agent, or Firm*—Richard C. Litman

(57) ABSTRACT

A programmable/semi-programmable pickup and transducer switching system includes a control, a plurality of switches communicatively interconnected to the control, an encoder communicatively interconnected to the control, a memory/buffer/drive with switching element options for passive or active pickup switching, said memory/buffer/drive being communicatively interconnected to the control, and a display system communicatively interconnected to the memory/buffer/drive. The display system includes at least one transparent fastening screw with an associated light emitting diode configured to provide a visual indication of an associated pickup activity.

18 Claims, 26 Drawing Sheets

U.S. PATENT DOCUMENTS

| | | | | |
|---|---|---|---|---|
| 5,837,912 | A | 11/1998 | Eagen | 84/267 |
| 5,866,834 | A | 2/1999 | Burke et al. | 84/622 |
| 6,121,537 | A | 9/2000 | Pawar et al. | 84/278 |
| 6,253,654 | B1 | 7/2001 | Mercurio | 84/267 |
| 6,353,169 | B1 | 3/2002 | Juszkiewicz et al. | 84/600 |
| 6,686,530 | B1 | 2/2004 | Juszkiewicz et al. | 84/600 |
| 2003/0145715 | A1 | 8/2003 | Wnorowski | 84/726 |
| 2004/0003709 | A1 | 1/2004 | Kinman | 84/728 |
| 2004/0069127 | A1 | 4/2004 | Ludwig | 84/645 |

FOREIGN PATENT DOCUMENTS

| | | | |
|---|---|---|---|
| GB | 2 207 542 | A | 2/1989 |
| WO | WO 2004/008428 | A2 | 1/2004 |

OTHER PUBLICATIONS

Tokai electric guitar for sale at Guitar Doctor, http://www.guitardoctor.com/inventory_pages/tokai_black.htm [online], retrieved Jun. 11, 2004, one page.

How the Electronics Work on Your Gibson Guitar, http://www.Gibson.com//reference/infoguides/5.html [online], retrieved Jun. 11, 2004, two pages.

Fenders S-1 Switching System, http//www.fender.com/products/s1/ [online] retrieved Jun. 11, 2004, two pages.

2000

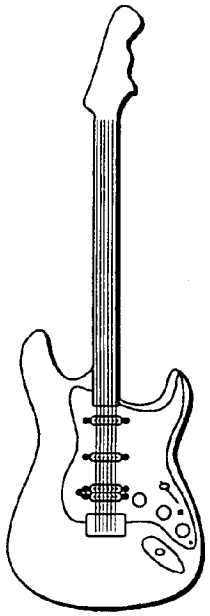

15 True Single Coil Sounds Using 2 Single Coils and 1 Humbucker in the Treble Position

2100

| Switch Positions / Pickup Coils | With Push/Pull Mode Switch ($V_{SW1}$) Down | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|---|
| Neck Pickup | = | Off | ● | ● | | | ● | ● | | | ● | ● | | | ● | ● | |
| Middle Pickup | = | Off | | ● | ● | ● | ● | | | | | ● | ● | ● | ● | | |
| Treble Humbucker (Stud Coil) | = | Off | | | | ● | ● | ● | ● | ● | ● | ● | ● | | | | |
| Treble Humbucker (Screw Bobbin) | = | Off | | | | | | | | ● | ● | ● | ● | ● | ● | ● | ● |
| Note: ● = On | | | | | | | | | | | | | | | | | |

4 Additional Humbucking Sounds Using 1 Humbucker in the Treble Position and 2 Single Coils

2200

| Switch Positions / Pickup Coils | With Push/Pull Mode Switch ($V_{SW1}$) Up | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|---|
| Neck Pickup | = | Off | ● | ● | | | ● | ● | | | ● | ● | | | ● | ● | |
| Middle Pickup | = | Off | | ● | ● | ● | ● | | | | | ● | ● | ● | ● | | |
| Treble Humbucker (Stud Coil) | = | Off | | | | ● | ● | ● | ● | ● | ● | ● | ● | | | | |
| Treble Humbucker (Screw Bobbin) | = | Off | | | | | | | | ● | ● | ● | ● | ● | ● | ● | ● |
| Note: ● = On | | | | | | | | | | | | | | | | | |
| Note: ● = Series Humbucking On | | | | | | | | | | | | | | | | | |
| Note: ● = Same as True Single Coil Modes | | | | | | | | | | | | | | | | | |

*Fig. 16*

Programmable and Semi-Programmable System (1 Instant Preset Location) Achieves 22 Sounds in This Pickup Configuration

2400

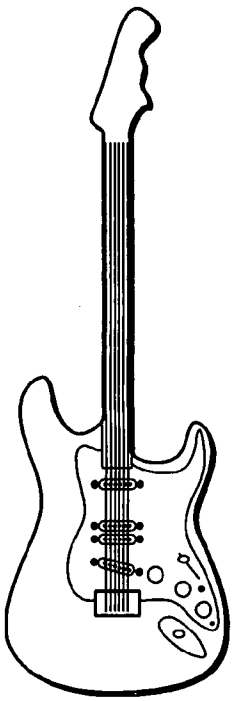

2500

| | | 15 True Single Coil Sounds using 4 In Phase Single Coils Pickups | | | | | | | | | | | | | | | |
|---|---|---|---|---|---|---|---|---|---|---|---|---|---|---|---|---|---|
| **Switch Positions** / **Pickup Coils** | With Push/Pull Mode Switch (Vsw1) **Down** | 0 | 1 | 2 | 3 | 4 | 5 | 6 | 7 | 8 | 9 | 10 | 11 | 12 | 13 | 14 | 15 |
| Neck Pickup | = | Off | • | • | | | • | • | | | • | • | | | • | • | |
| Middle Pickup | = | Off | | • | • | • | • | | | | | • | • | • | • | | |
| New Inbetween Pickup | = | Off | | | | • | • | • | • | • | • | • | • | | | | |
| Slanted Bridge Pickup | = | Off | | | | | | | | • | • | • | • | • | • | • | • |
| Note: • = On | | | | | | | | | | | | | | | | | |
| | | 7 Additional Out Of Phase Sounds using 1 Single Coil Pickup wired for a Phase Reversal | | | | | | | | | | | | | | | |
| **Switch Positions** / **Pickup Coils** | With Push/Pull Mode Switch (Vsw1) **Up** | 0 | 1 | 2 | 3 | 4 | 5 | 6 | 7 | 8 | 9 | 10 | 11 | 12 | 13 | 14 | 15 |
| Neck Pickup | = | Off | • | • | | | • | • | | ○ | ○ | ○ | ○ | ○ | ○ | ○ | |
| Middle Pickup | = | Off | | • | • | • | • | | | ○ | ○ | ○ | ○ | ○ | ○ | ○ | |
| New Inbetween Pickup | = | Off | | | | • | • | • | • | ○ | ○ | ○ | ○ | ○ | ○ | ○ | |
| Slanted Bridge Pickup | = | Off | | | | | | | | ○ | ○ | ○ | ○ | ○ | ○ | ○ | • |
| Note: • = Same as Single Coil Modes | | | | | | | | | | | | | | | | | |
| Note: ○ = A Single Coil Out of Phase | | | | | | | | | | | | | | | | | |

2600

*Fig. 17*

PROGRAMMABLE/SEMI-PROGRAMMABLE PICKUP AND TRANSDUCER SWITCHING SYSTEM

CROSS-REFERENCE TO RELATED APPLICATION

This application claims the benefit of U.S. Provisional Patent Application Ser. No. 60/588,679, filed Jul. 15, 2004, which is incorporated herein by reference.

BACKGROUND OF THE INVENTION

1. Field of the Invention

The present invention relates generally to switching systems for musical instruments and, more particularly to a programmable pickup and transducer switching system for the selection of multiple pickups and transducers for musical instruments.

2. Description of the Related Art

Electric guitars and other electric instruments typically provide one or more pickups that "pickup" the steel strings within the electro-magnetic field or pole of the pickup system to produce an electric signal output when the steel strings are moving while being played. Likewise, transducers that reside under a bridge saddle or under each individual string saddle provide amplification for nylon string type instruments or allow for an acoustic type sound of instruments with steel strings employing transducers in addition to the magnetic pickups.

Many types of pickups and transducers exist and each produce specific tone and timbre qualities depending on the location where these pickups are placed under the strings. Depending on the type of pickup configurations, the instrument can produce even more unique tones and timbre sound qualities. The electric signals produced by the plurality of pickup locations and pickup types are sent to an amplifier or recording device from which the instrument's sound can be heard. Many switching schemes and systems provide different combinations for when the pickups are on and active producing sound or not. That is, switching systems allow a musician to change, in real time, the sound of his/her musical instrument during a musical performance at times of their discretion. Prior art switching or selection systems do not provide for full combinatorial Boolean logic of possible combinations of pickup selections, that is two raised to the number of pickups installed on an instrument. The number two is used because a pickup can be selected on or off. Using an instrument with four pickups, two raised to the fourth, equals sixteen possible selections or combinatorial Boolean logic expressions of four pickups mixing on and off with each other. Furthermore, the prior art does not provide a method for quick, convenient switching of selection of pickups in a way conducive to real time live performance or in recording situations.

Therefore, a need exists for programmable/semi-programmable pickup and transducer switching systems for the selection of multiple pickups and transducers for musical instruments, that enables programming with great ease (even while in live and real time performance), and provides many combinations of pickup selections ranging in multiple pickup numbers, such as three, four, five, etc., single coil or single coil mixed with humbucking configurations and/or piezo type transducers.

SUMMARY OF THE INVENTION

The present invention provides both semi-programmable and fully programmable pickup and transducer switching systems that can be used independently from each other or as a combination of both systems together. The programmable/semi-programmable pickup and transducer switching system includes a control, a plurality of switches communicatively interconnected to the control, an encoder communicatively interconnected to the control, a memory/buffer/drive with switching element options for passive or active pickup switching, said memory/buffer/drive being communicatively interconnected to the control, and a display system communicatively interconnected to the memory/buffer/drive. The display system includes at least one transparent fastening screw with an associated light emitting diode (LED) or LEDs on a side of single coil or humbucking pickup, pickup covers, and enclosures on or around a pickup retaining ring surrounding a pickup that is configured to provide a visual indication of any associated pickup activity.

BRIEF DESCRIPTION OF THE DRAWINGS

FIG. 16 is a view and chart of various musical instrument pickup combinations offered by a programmable/semi-programmable pickup and transducer switching system according to the present invention.

FIG. 17 is a view and chart of various musical instrument pickup combinations with special placement of pickup locations offered by a programmable/semi-programmable pickup and transducer switching system according to the present invention.

Similar reference characters denote corresponding features consistently throughout the attached drawings.

DETAILED DESCRIPTION OF THE PREFERRED EMBODIMENTS

Figure 1:
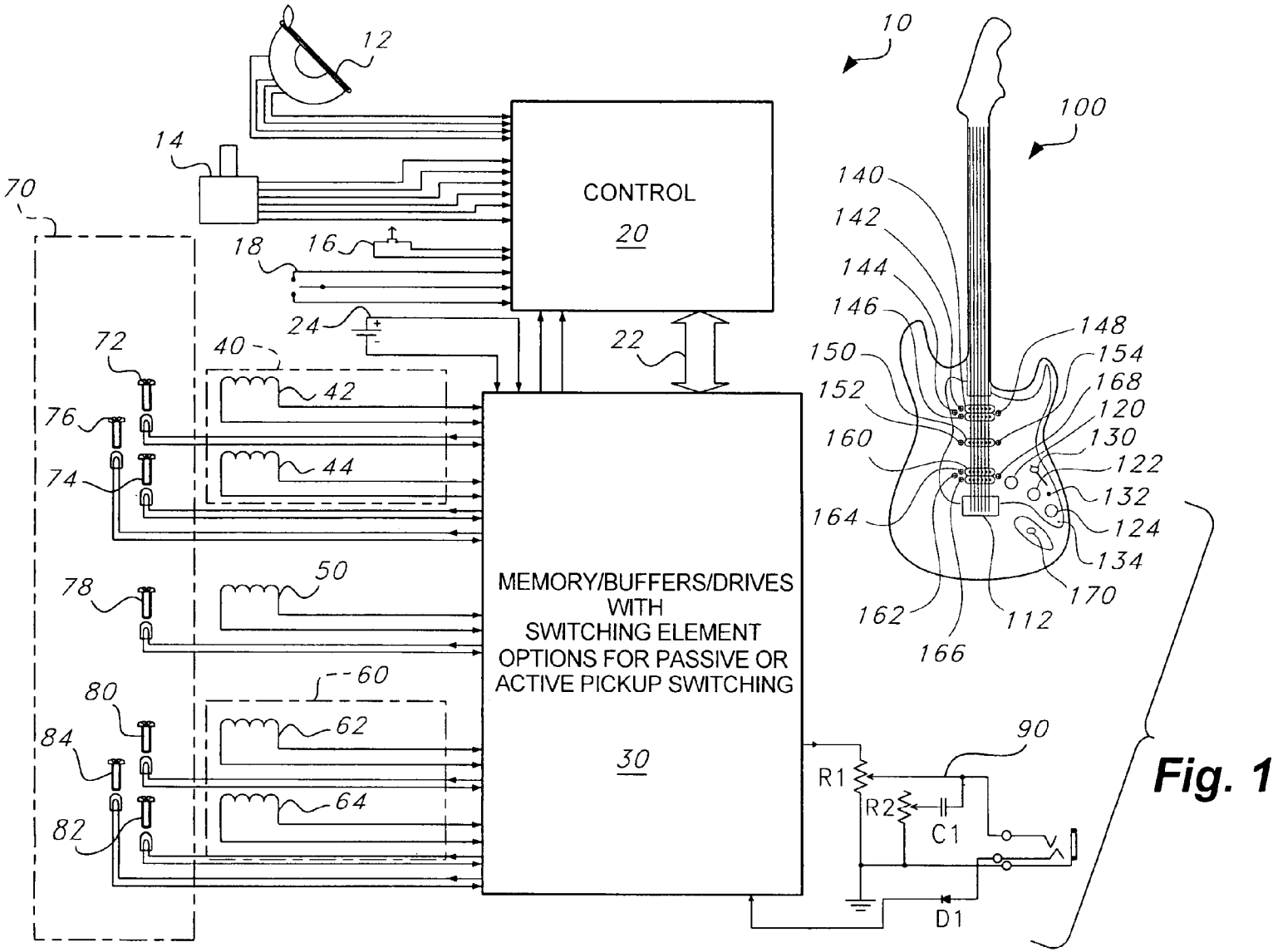
FIG. 1 is a programmable/semi-programmable pickup and transducer switching system according to the present invention.

The present invention is a programmable/semi-programmable pickup and transducer switching system. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Referring now to the drawings, FIG. 1 shows a programmable/semi-programmable pickup and transducer switching system 10 according to the present invention. The system 10 is configured to simplify the selection, by a musician, of multiple pickups and transducers for musical instruments. The system 10 is configured for use with any type of stringed musical instrument with pickups, such as an electric guitar 100 or the like. More particularly, the system 10 is preferably configured for use with electric guitars, acoustic/electric guitars, or electric bass guitars employing from three to five electromagnetic pickups, transducers, or a mixture of piezo and electromagnetic pickups for the production of an instrument's sound quality and output characteristics.

The system 10 includes a switch 12, an encoder 14, and switches 16 and 18 communicatively interconnected with a control 20. The control 20 is preferably configured as an integral control logic board and is communicatively interconnected to memory/buffers/drives 30 via communication bus 22. Such a control configuration does not use microprocessors, microcontrollers or field programmable gate arrays, and allows for low noise operation with very efficient power consumption. The memory/buffers/drives 30 are configured with switching element options for passive and/or active pickup switching. The memory/buffers/drives 30 are communicatively interconnected to an indication or display system 70 to indicate the on or off status of each particular pickup or system status.

The switch 12 is a pickup selector switch, preferably a five position blade switch or the like, and is used to select a particular pickup or combination of pickups in order to achieve a desired sound. The switch 12 may configured as any type of switch, such as a slide switch, toggle switch, rotary multiple position selector switch, three position on/on/on switch etc. When attached to a small printed circuit board (PCB), the switch 12 can replace an existing five position switch and be located within a SRATOCASTOR type guitar with very minimal, and in some cases no need for any additional drilling or routering. The encoder 14 is preferably a rotary encoder for setting parameters. The switch 16 is preferably a small or micro-sized momentary, normally open, push button switch located below the encoder 14 (e.g., second tone control position), and is used to save the current pickup selection to memory.

The switch 18 is preferably a micro-sized or standard sized three position switch common in the arts, and can be used for BANK selection in groups of five (due to the standard five position switch) for three by five selecting of fifteen preprogrammed selections of pickup combinations and/or single coil or humbucking type configurations. Alternatively, the three position switch may be replaced with a five position switch for five by five or twenty five user programmable selections of pickup combinations of single coil and humbucking type configurations for recall during real time performance.

Figure 23:
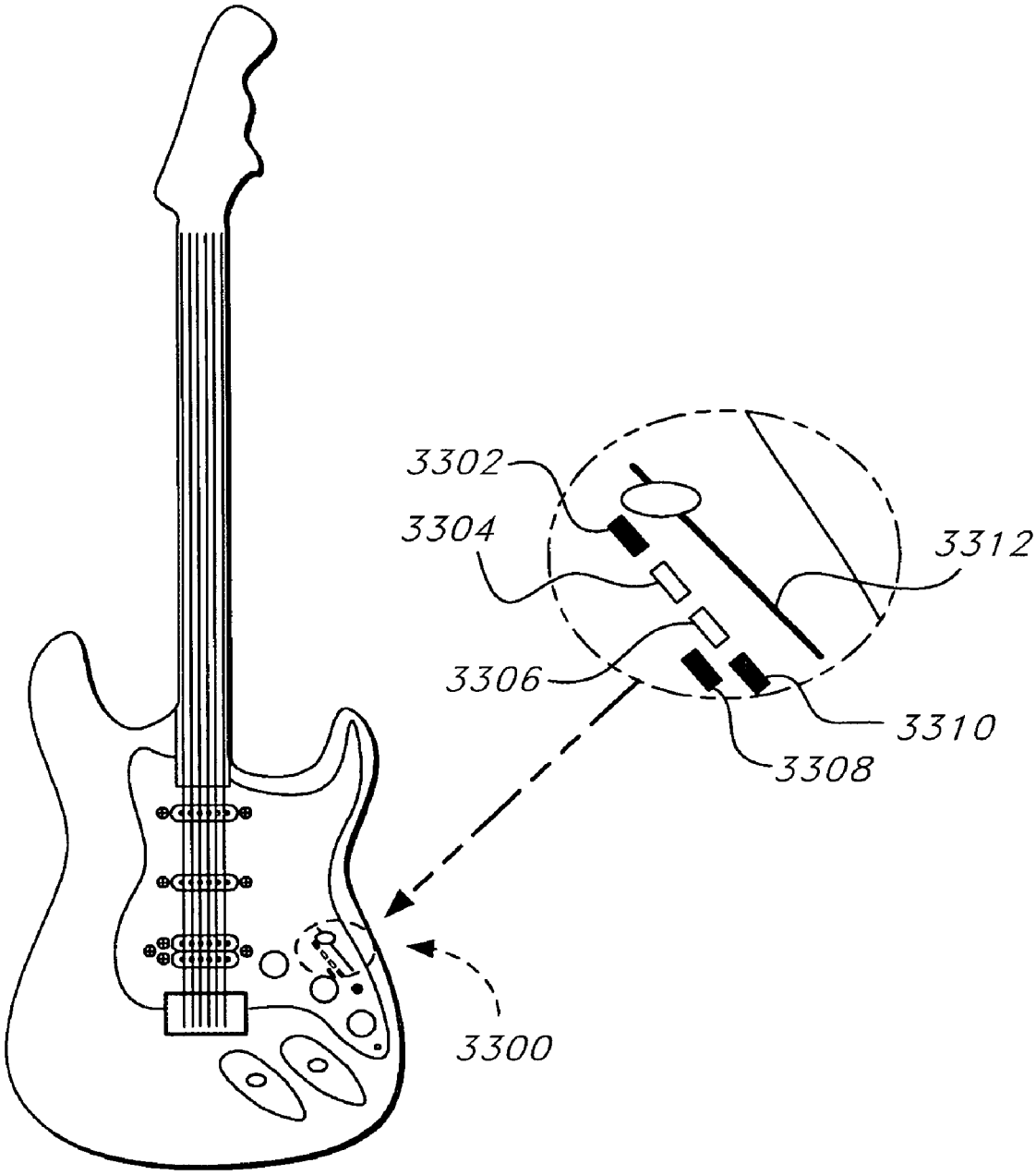
FIG. 23 is a front view of a six string guitar further provided with display LEDs located adjacent and parallel to the five position blade switch, from below the pickguard or wood on the PCB board according to the present invention.

The indication or display system 70 includes light emitting diodes (LEDs) mounted under transparent fastening screws used to hold pickups and pickup elements in place on an instrument. Likewise, use of standard or SMT type LEDs can be used in the pickguard itself near the pickups or within the pickup itself or pickup ring around the pickup, or close and parallel to the five position blade switch, as seen in FIG. 23 and further described below. The display system 70 illustrates transparent fastening screws 72 and 74 and associated LEDs to provide single coil mode indication of single coil/humbucking type pickups 42 and 44. Transparent fastening screw 76 and an associated LED provide a humbucking mode indication of single coil/humbucking type pickups 42 and 44. Transparent fastening screw 78 and an associated LED provide a single coil mode indication of single coil pickup 50. Transparent fastening screws 80 and 82 and associated LEDs provide single coil mode indication of single coil/humbucking type pickups 62 and 64. Transparent fastening screw 84 and an associated LED provide a humbucking mode indication of single coil/humbucking type pickups 62 and 64. The system 10 is powered by a direct current power source 24, such as a nine volt battery or the like. Alternatively the system 10 may be powered by an optional remote power source viacircuitry 90.

The guitar 100 shown in FIG. 1 is configured as a STRATOCASTOR type of six-string guitar with multiple pickup configurations. The guitar 100 has a body with a neck. The guitar 100 is configured with the programmable/semi-programmable pickup and transducer system 10. A bridge saddle 112 is mounted on the guitar 100. The guitar 100 includes a volume control knob 120, tone control knob 122, and a rotary encoder 124, as well as a five position blade switch 130, a three position BANK selector switch 132, and a save push button 134. An upper four wire humbucking neck position pickup 140 is attached to the guitar 100 by transparent fastening screws 142, 144 and 146, and a standard fastening adjustment screw 148. The transparent fastening screws 142, 144 and 146 still allow for pickup height adjustments as does the standard fastening adjustment screw 148. An LED having any desired color is mounted below the transparent fastening screw 142 and, when illuminated, provides a single coil mode indication for the upper half of pickup 140. An LED having any desired color is mounted below the transparent fastening screw 146 and, when illuminated, provides a single coil mode indication for the lower half of pickup 140. An LED having any desired color is mounted below the transparent fastening screw 144 and, when illuminated, provides a humbucking mode indication for the entire pickup 140.

A mid position pickup 150 is attached to the guitar 100 by a transparent fastening screw 152 and a standard fastening adjustment screw 154. An LED having any desired color is mounted below the transparent fastening screw 152 and, when illuminated, provides a single coil mode indication for the pickup 150.

A lower four wire humbucking bridge pickup 160 is attached to the guitar 100 by transparent fastening screws 162, 164 and 166, and a standard fastening adjustment screw 168. The transparent fastening screws 162, 164 and 166 still allow for pickup height adjustments as does the standard fastening adjustment screw 168. An LED having any desired color is mounted below the transparent fastening screw 164 and, when illuminated, provides a single coil mode indication for the upper half of pickup 160. An LED having any desired color is mounted below the transparent fastening screw 166 and, when illuminated, provides a single coil mode indication for the lower half of pickup 160. An LED having any desired color is mounted below the transparent fastening screw 162 and, when illuminated, provides a humbucking mode indication for the entire pickup 160. The guitar 100 provides an output signal via output port 170.

Figure 2:
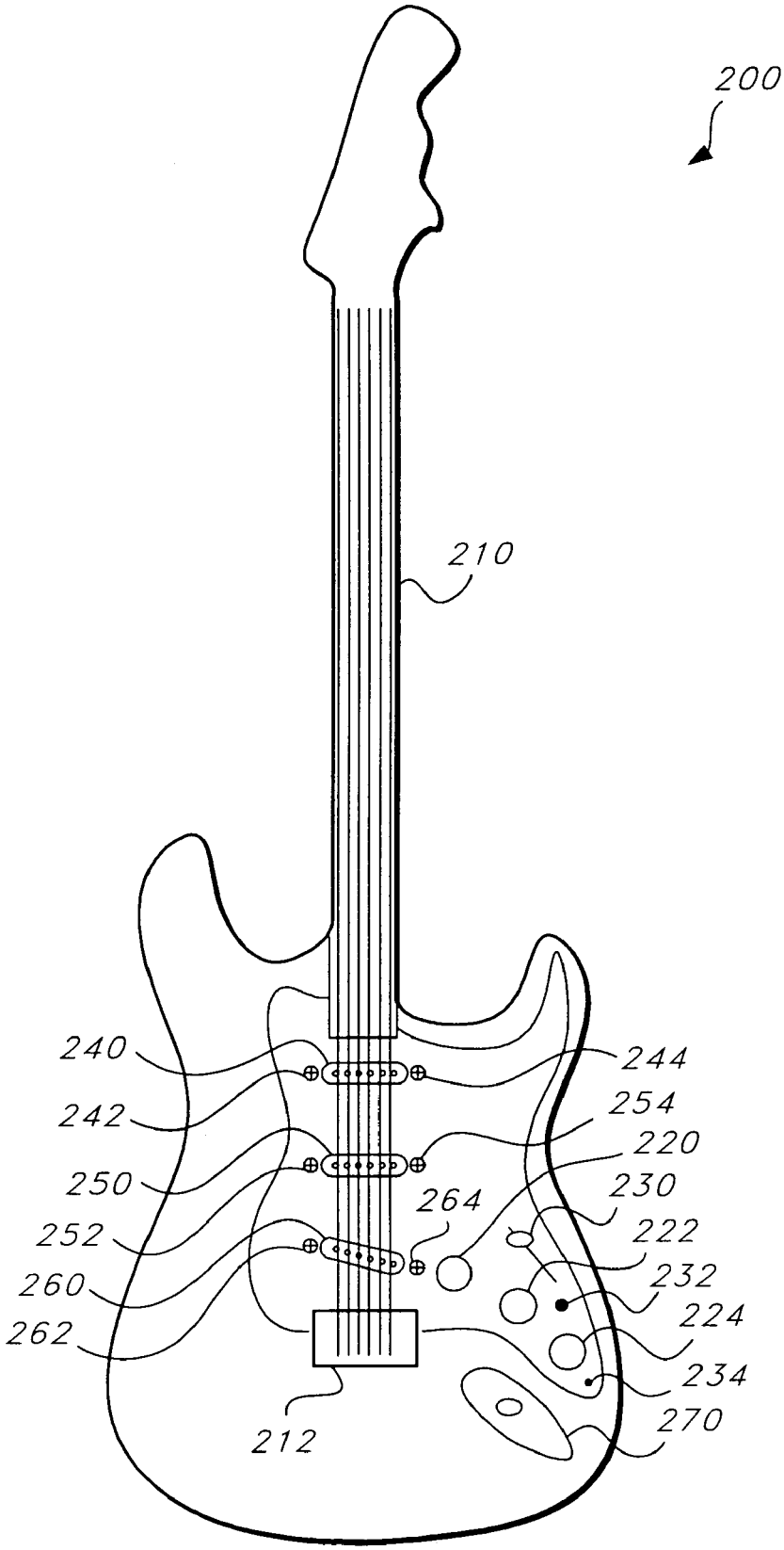
FIG. 2 is a front view pickup configuration of a six-string guitar equipped with a programmable/semi-programmable pickup and transducer switching system according to the present invention.

FIG. 2 shows a six-string guitar 200 with a body with a neck 210. The guitar 200 is configured with the programmable/semi-programmable pickup and transducer system 10. A bridge saddle 212 is mounted on the guitar 200. The guitar 200 includes a volume control knob 220, tone control knob 222, and a rotary encoder 224, as well as a five position blade switch 230, a three position BANK selector switch 232, and a save/store push button 234. An upper pickup 240 is attached to the guitar 200 by a transparent fastening screw 242 and a standard adjustment screw 244.

An LED having any desired color is mounted below the transparent fastening screw 242 and, when illuminated, provides a single coil mode indication for the pickup 240. A mid pickup 250 is attached to the guitar 200 by a transparent fastening screw 252 and a standard adjustment screw 254. An LED having any desired color is mounted below the transparent fastening screw 252 and, when illuminated, provides a single coil mode indication for the pickup 250.

A lower bridge pickup 260 is attached to the guitar 200 by transparent fastening screw 262 and standard adjustment screw 264. An LED having any desired color is mounted below the transparent fastening screw 262 and, when illuminated, provides a single coil mode indication for the pickup 260. The guitar 200 provides an output signal via output port 270.

Figure 3:
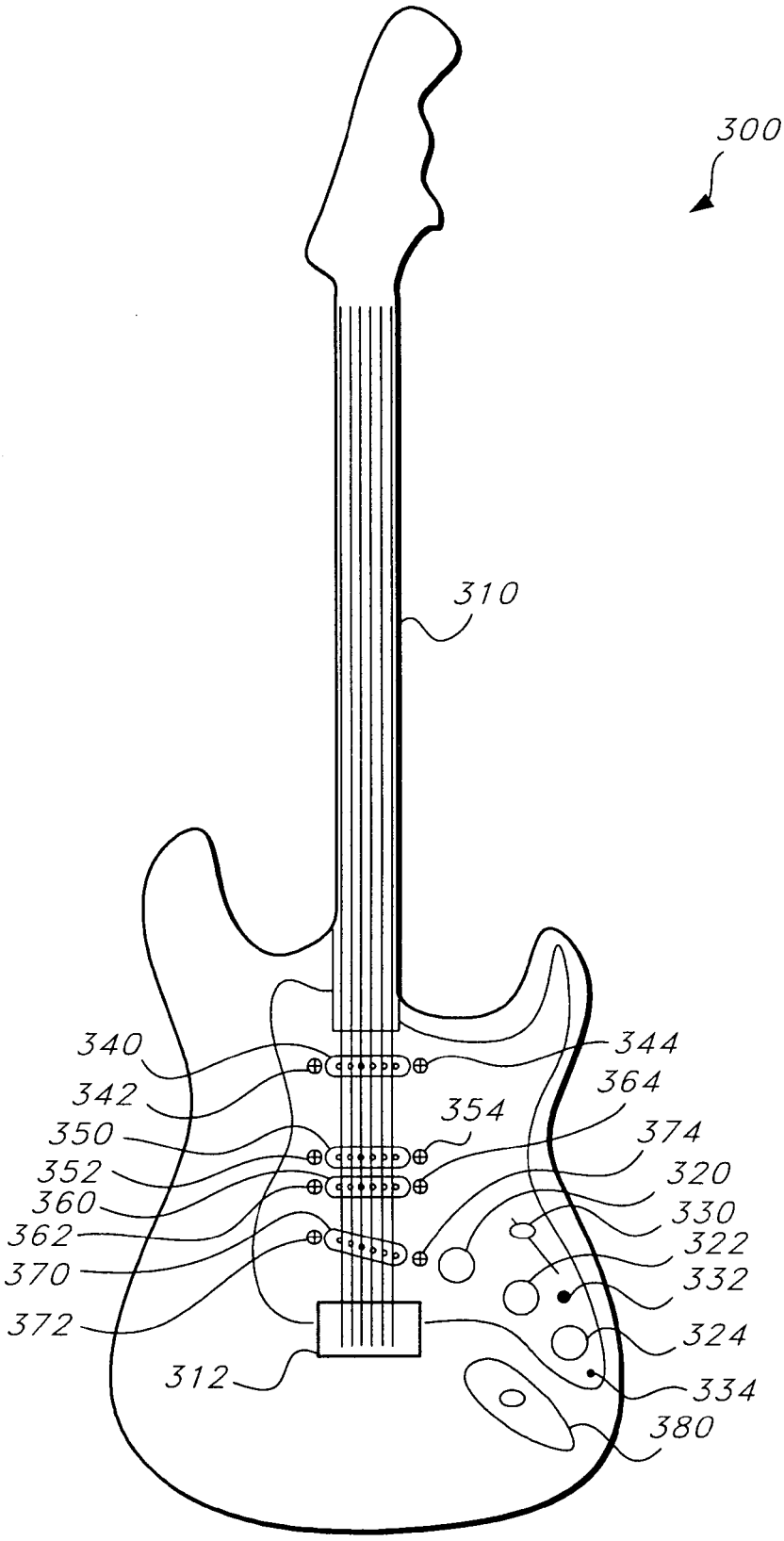
FIG. 3 is a front view pickup configuration of a six-string guitar equipped with a programmable/semi-programmable pickup and transducer switching system according to the present invention.

FIG. 3 shows a six-string guitar 300 with a body with a neck 310. The guitar 300 is configured with the programmable/semi-programmable pickup and transducer system 10. A bridge saddle 312 is mounted on the guitar 300. The guitar 300 includes a volume control knob 320, tone control knob 322, and a rotary encoder 324, as well as a five position blade switch 330, a three position BANK selector switch 332, and a save/store push button 334. An upper neck pickup 340 is attached to the guitar 300 by a transparent fastening screw 342 and a standard adjustment screw 344.

An LED having any desired color is mounted below the transparent fastening screw 342 and, when illuminated, provides a single coil mode indication for the upper neck pickup 340. An upper mid position pickup 350 is attached to the guitar 300 by a transparent fastening screw 352 and a standard adjustment screw 354. An LED having any desired color is mounted below the transparent fastening screw 352 and, when illuminated, provides a single coil mode indication for the pickup 350. A lower mid position pickup 360 is attached to the guitar 300 by a transparent fastening screw 362 and a standard adjustment screw 364. An LED having any desired color is mounted below the transparent fastening screw 362 and, when illuminated, provides a single coil mode indication for the lower mid position pickup 360.

A lower bridge position pickup 370 is attached to the guitar 300 by transparent fastening screw 372 and standard adjustment screw 374. An LED having any desired color is mounted below the transparent fastening screw 372 and, when illuminated, provides a single coil mode indication for the pickup 370. In the case of the FIG. 3 style guitar 300, specific harmonic placement of the four single coil pickups are mounted under the strings to maximize the effect of the individual tonalities produced by each pickup when mixed under programmable/semi-programmable pickup selecting modes. This is done by placing the center of pickup poles 340 under the second octave harmonic of all open strings, placing the center of pickup poles 350 under the fifth harmonic of all open strings, placing the center of pickup poles 360 under the third octave harmonic of all open strings and finally placing the center of pickup poles 370 exactly an additional half inch from under the third fifth harmonic at the "Low E" string side and the center of pickup poles 370 exactly and additional eight tenths of an inch from under the third fifth harmonic at the "High E" stringside. This optimizes the tonalities blended by programmable/semi-programmable switching modes of major and minor key signatures in keys E, A, D, G and B. The guitar 300 provides an output signal via output port 380.

Figure 4:
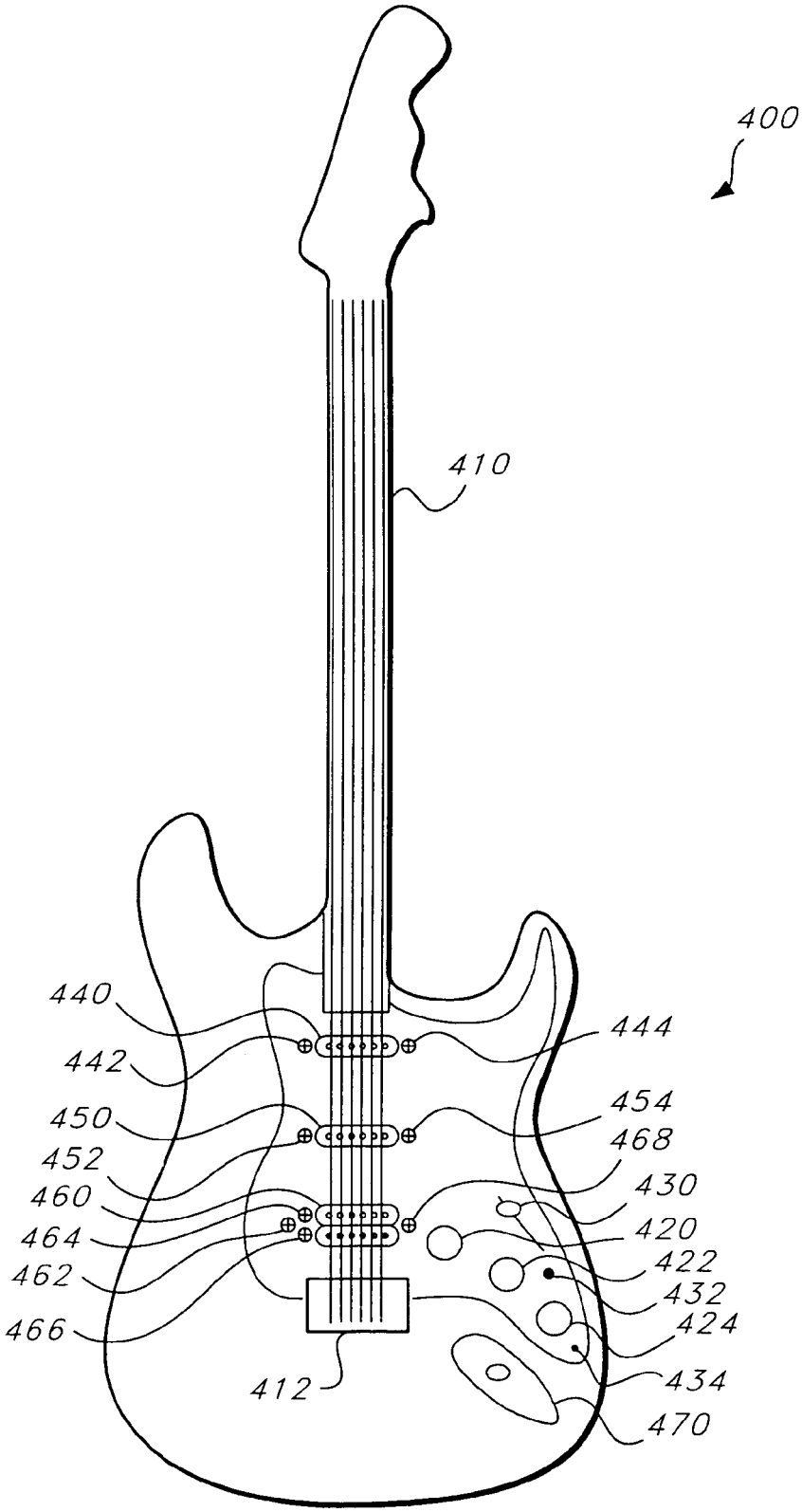
FIG. 4 is a front view pickup configuration of a six-string guitar equipped with a programmable/semi-programmable pickup and transducer switching system according to the present invention.

FIG. 4 shows a six-string guitar 400 with a body and a neck 410. The guitar 400 is configured with the programmable/semi-programmable pickup and transducer system 10. A bridge saddle 412 is mounted on the guitar 400. The guitar 400 includes a volume control knob 420, tone control knob 422, and a rotary encoder 424, as well as a five position blade switch 430, a three position BANK selector switch 432, and a save/store push button 434.

An upper neck pickup 440 is attached to the guitar 400 by a transparent fastening screw 442 and a standard adjustment screw 444. An LED having any desired color is mounted below the transparent fastening screw 442 and, when illuminated, provides a single coil mode indication for the pickup 440. A mid position pickup 450 is attached to the guitar 400 by a transparent fastening screw 452 and a standard adjustment screw 454. An LED having any desired color is mounted below the transparent fastening screw 452 and, when illuminated, provides a single coil mode indication for the pickup 450.

A lower four wire humbucking bridge pickup 460 is attached to the guitar 400 by transparent fastening screw 462 and standard adjustment screw 468. An LED having any desired color is mounted below the transparent screw 462 and, when illuminated, provides a humbucking mode indication for the pickup 460. An LED having any desired color is mounted below the transparent screw 464 and, when illuminated, provides a single coil mode indication for the upper half of pickup 460. An LED having any desired color is mounted below the transparent screw 466 and, when illuminated, provides a single coil mode indication for the lower half of pickup 460. The guitar 400 provides an output signal via output port 470.

Figure 5:
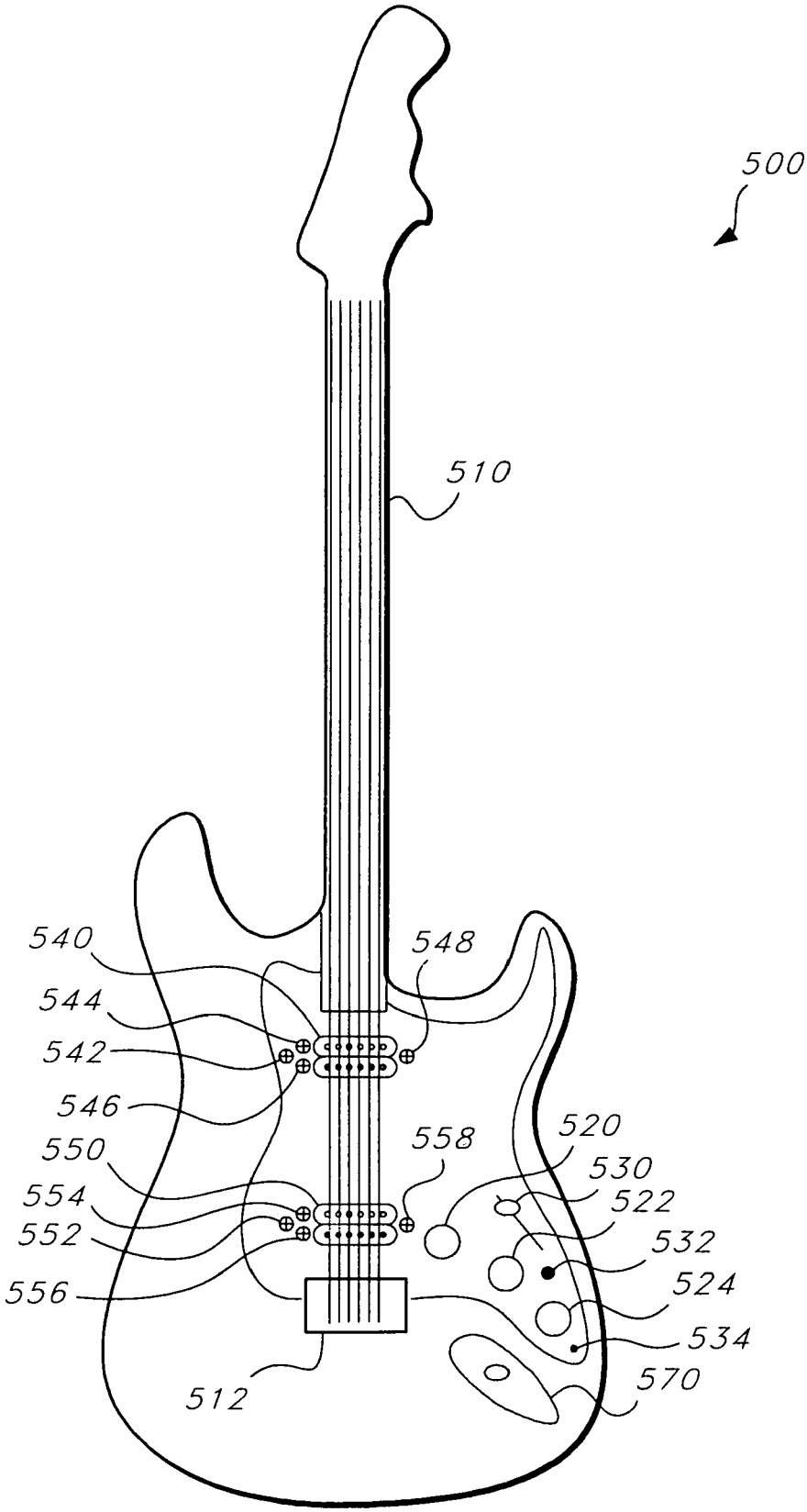
FIG. 5 is a front view pickup configuration of a six-string guitar equipped with a programmable/semi-programmable pickup and transducer switching system according to the present invention.

FIG. 5 shows a six-string guitar 500 with a body and a neck 510. The guitar 500 is configured with the programmable/semi-programmable pickup and transducer system 10. A bridge saddle 512 is mounted on the guitar 500. The guitar 500 includes a volume control knob 520, tone control knob 522, and a rotary encoder 524, as well as a five position blade switch 530, a three position BANK selector switch 532, and a save push button 534.

An upper four wire humbucking neck pickup 540 is attached to the guitar 500 by transparent fastening screw 542 and standard adjustment screw 548. An LED having any desired color is mounted below the transparent fastening screw 542 and, when illuminated, provides a humbucking mode indication for the pickup 540. An LED having any desired color is mounted below transparent screw 544 and, when illuminated, provides a single coil mode indication for the upper half of pickup 540. An LED having any desired color is mounted below transparent screw 546 and, when illuminated, provides a single coil mode indication for the lower half of pickup 540.

A lower four wire humbucking bridge pickup 550 is attached to the guitar 500 by a transparent fastening screw 552 and standard adjustment screw 558. An LED having any desired color is mounted below the transparent fastening screw 552 and, when illuminated, provides a humbucking mode indication for the pickup 550. An LED having any desired color is mounted below the transparent screw 554 and, when illuminated, provides a single coil mode indication for the upper half of pickup 550. An LED having any desired color is mounted below the transparent screw 556 and, when illuminated, provides a single coil mode indication for the lower half of pickup 550. The guitar 500 provides an output signal via output port 570.

Figure 6:
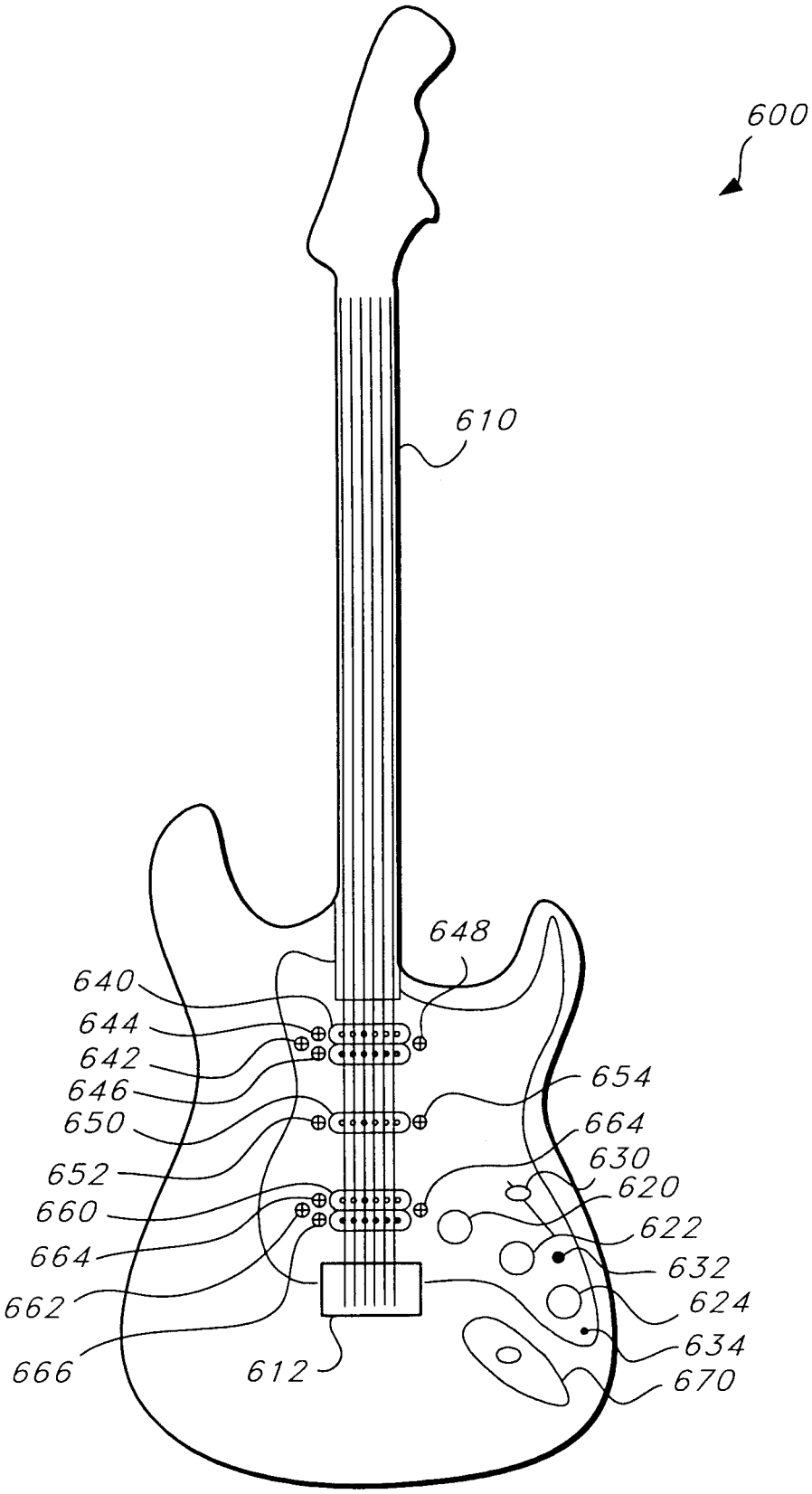
FIG. 6 is a front view pickup configuration of a six-string guitar equipped with a programmable/semi-programmable pickup and transducer switching system according to the present invention.

FIG. 6 shows a six-string guitar 600 with a body and a neck 610. The guitar 600 is configured with the programmable/semi-programmable pickup and transducer system 10. A bridge saddle 612 is mounted on the guitar 600. The guitar 600 includes a volume control knob 620, tone control knob 622, and a rotary encoder 624, as well as a five position blade switch 630, a three position BANK selector switch 632, and a save/store push button 634.

An upper four wire humbucking neck pickup 640 is attached to the guitar 600 by a transparent fastening screw 642 and standard adjustment screw 648. An LED having any desired color is mounted below the transparent fastening screw 642 and, when illuminated, provides a humbucking mode indication for the pickup 640. An LED having any desired color is mounted below the transparent screw 644 and, when illuminated, provides a single coil mode indication for the upper half of pickup 640. An LED having any desired color is mounted below the transparent screw 646 and, when illuminated, provides a single coil mode indication for the lower half of pickup 640.

A mid position pickup 650 is attached to the guitar 600 by a transparent fastening screw 652 and a standard adjustment screw 654. An LED having any desired color is mounted below the transparent fastening screw 652 and, when illuminated, provides a single coil mode indication for the pickup 650.

A lower four wire humbucking bridge position pickup 660 is attached to the guitar 600 by a transparent fastening screw 662 and standard adjustment screw 664. An LED having any desired color is mounted below the transparent fastening screw 662 and, when illuminated, provides a humbucking mode indication for the pickup 660. An LED having any desired color is mounted below the transparent screw 664 and, when illuminated, provides a single coil mode indication for the upper half of pickup 660. An LED having any desired color is mounted below the transparent screw 666 and, when illuminated, provides a single coil mode indication for the lower half of pickup 660. The guitar 600 provides an output signal via output port 670.

Figure 7:
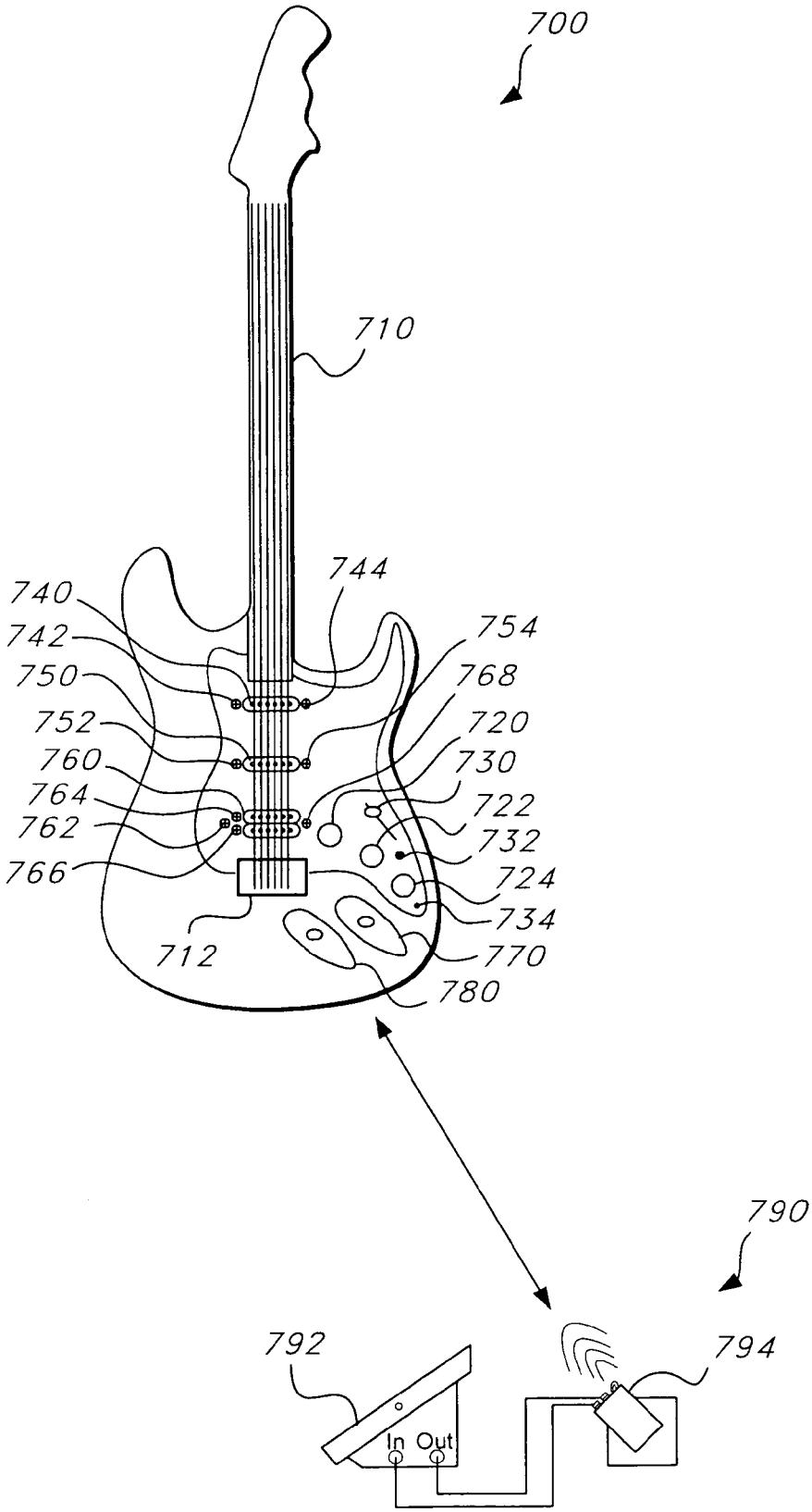
FIG. 7 is a view of a six-string guitar equipped with a programmable/semi-programmable pickup and transducer switching system and remote control option according to the present invention.

FIG. 7 shows a six-string guitar 700 with a body and a neck 710. The guitar 700 is configured with the programmable pickup and transducer system 10. A bridge saddle 712 is mounted on the guitar 700. The guitar 700 includes a volume control knob 720, tone control knob 722, and a rotary encoder 724, as well as a five position blade switch 730, a three position BANK selector switch 732, and a save/store push button 734.

An upper neck pickup 740 is attached to the guitar 700 by a transparent fastening screw 742 and a standard adjustment screw 744. An LED having any desired color is mounted below the transparent fastening screw 742 and, when illuminated, provides a single coil mode indication for the pickup 740.

A mid position pickup 750 is attached to the guitar 700 by a transparent fastening screw 752 and a standard adjustment screw 754. An LED having any desired color is mounted below the transparent fastening screw 752 and, when illuminated, provides a single coil mode indication for the pickup 750.

A lower four wire humbucking bridge pickup 760 is attached to the guitar 700 by a transparent fastening screw 762 and standard adjustment screw 768. An LED having any desired color is mounted below the transparent fastening screw 762 and, when illuminated, provides a humbucking mode indication for the pickup 760. An LED having any desired color is mounted below the transparent screw 764 and, when illuminated, provides a single coil mode indication for the upper half of pickup 760. An LED having any desired color is mounted below the transparent screw 766 and, when illuminated, provides a single coil mode indication for the lower half of pickup 760. The guitar 700 provides an audio output signal via output port 770.

Figure 8:
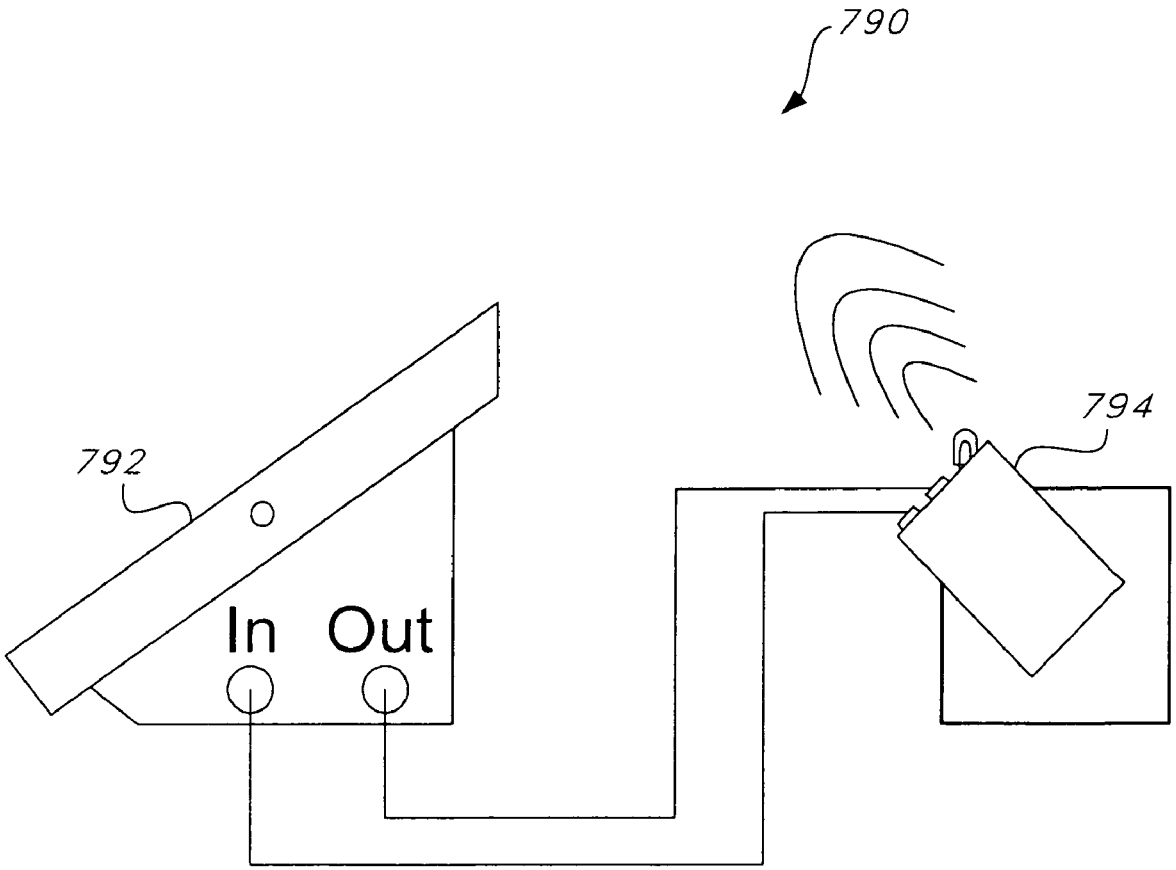
FIG. 8 is a view of a side view of connection plate with an infrared (IR) transmitter/receiver configured for use with a programmable/semi-programmable pickup and transducer switching system according to the present invention.

The guitar 700 is remotely controlled in a wireless manner through wireless port 780 via a device 790 which may be located on the floor and aimed at the guitar 700. A larger view of device 790 is shown in FIG. 8. A standard volume pedal 792 can be used to plug into the pickup rate switcher to vary the effect of the tempo of the pickup switching. The system 10 can be optionally configured to enable the display system LEDs 742, 752 and 762 to be used as receivers or transmitters to exchange data or to switch the system 10 remotely.

Figure 9A:
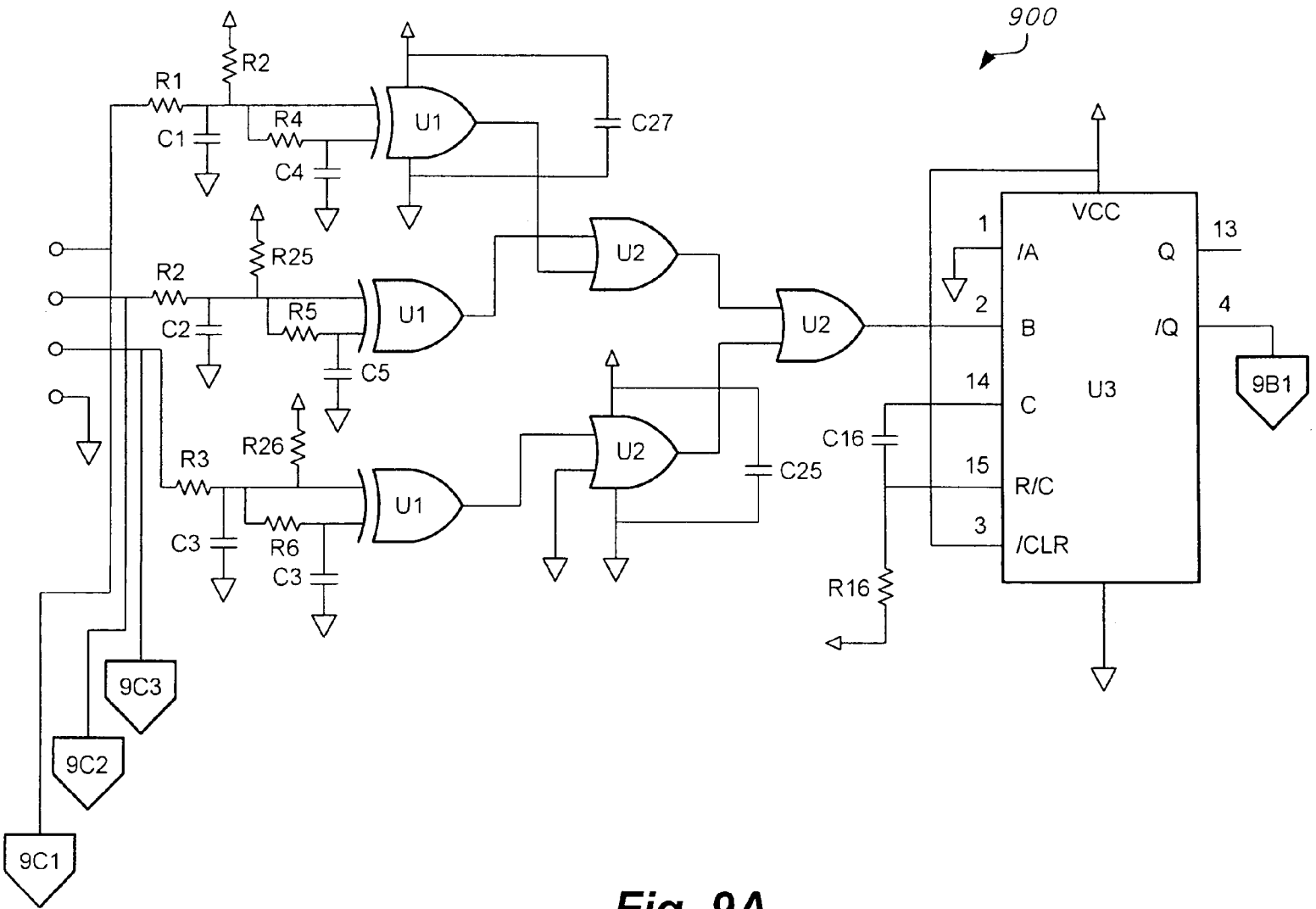
FIGS. 9A, 9B, and 9C are a schematic diagram of a clocking circuit used to time and program random access memory (RAM) in a programmable/semi-programmable pickup and transducer switching system according to the present invention.
Figure 9B:
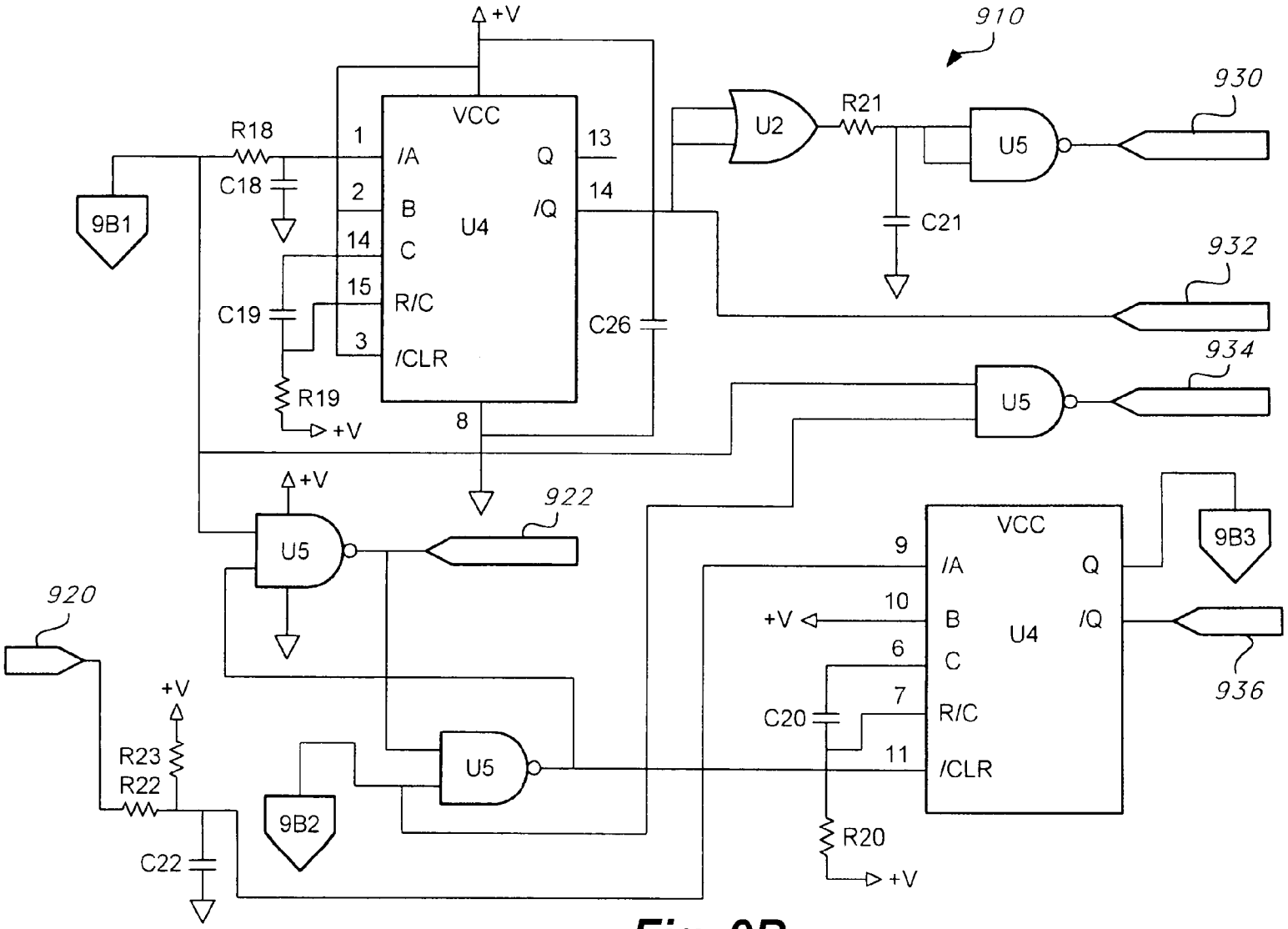
Figure 9C:
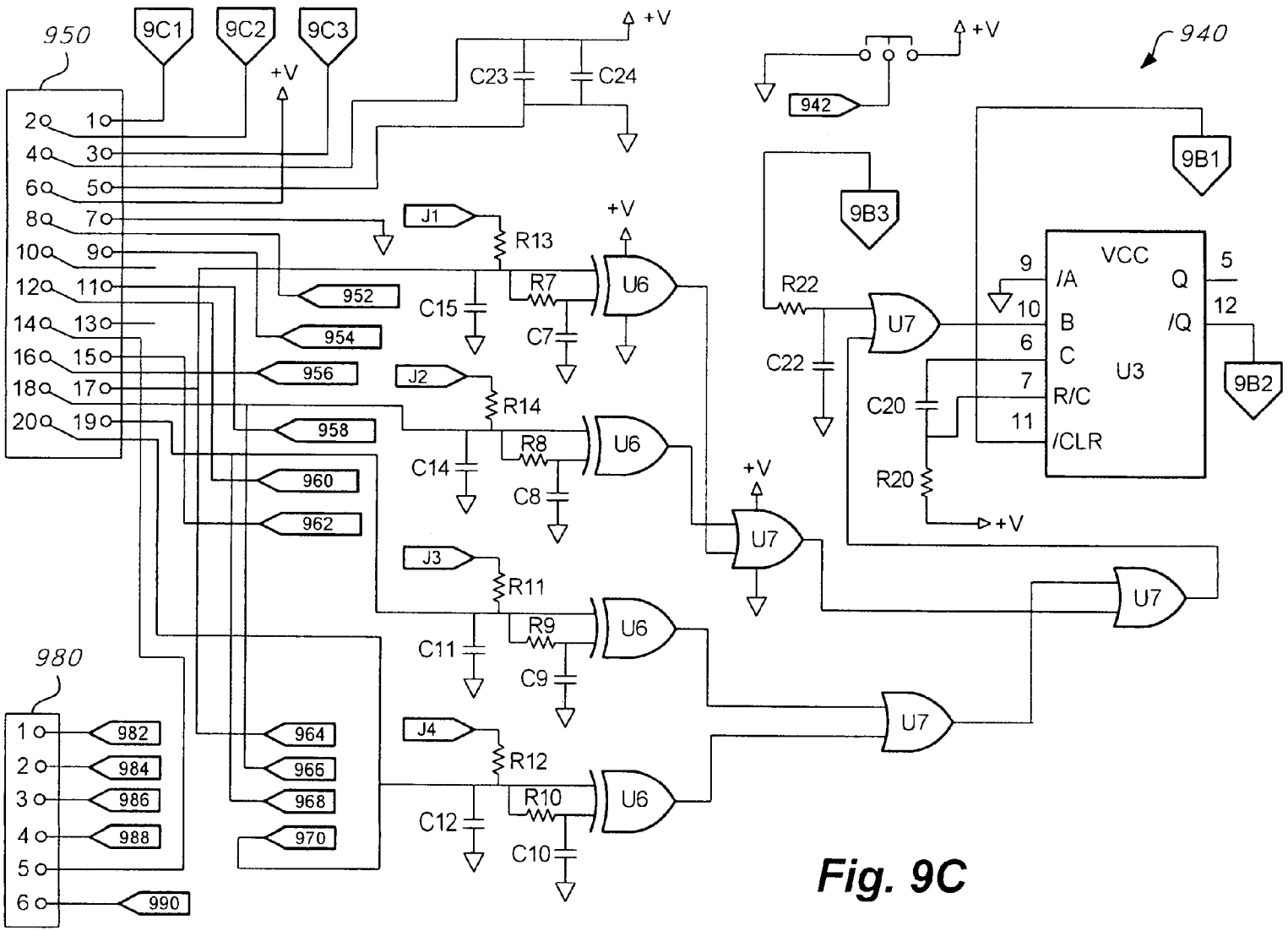
Figure 10A:
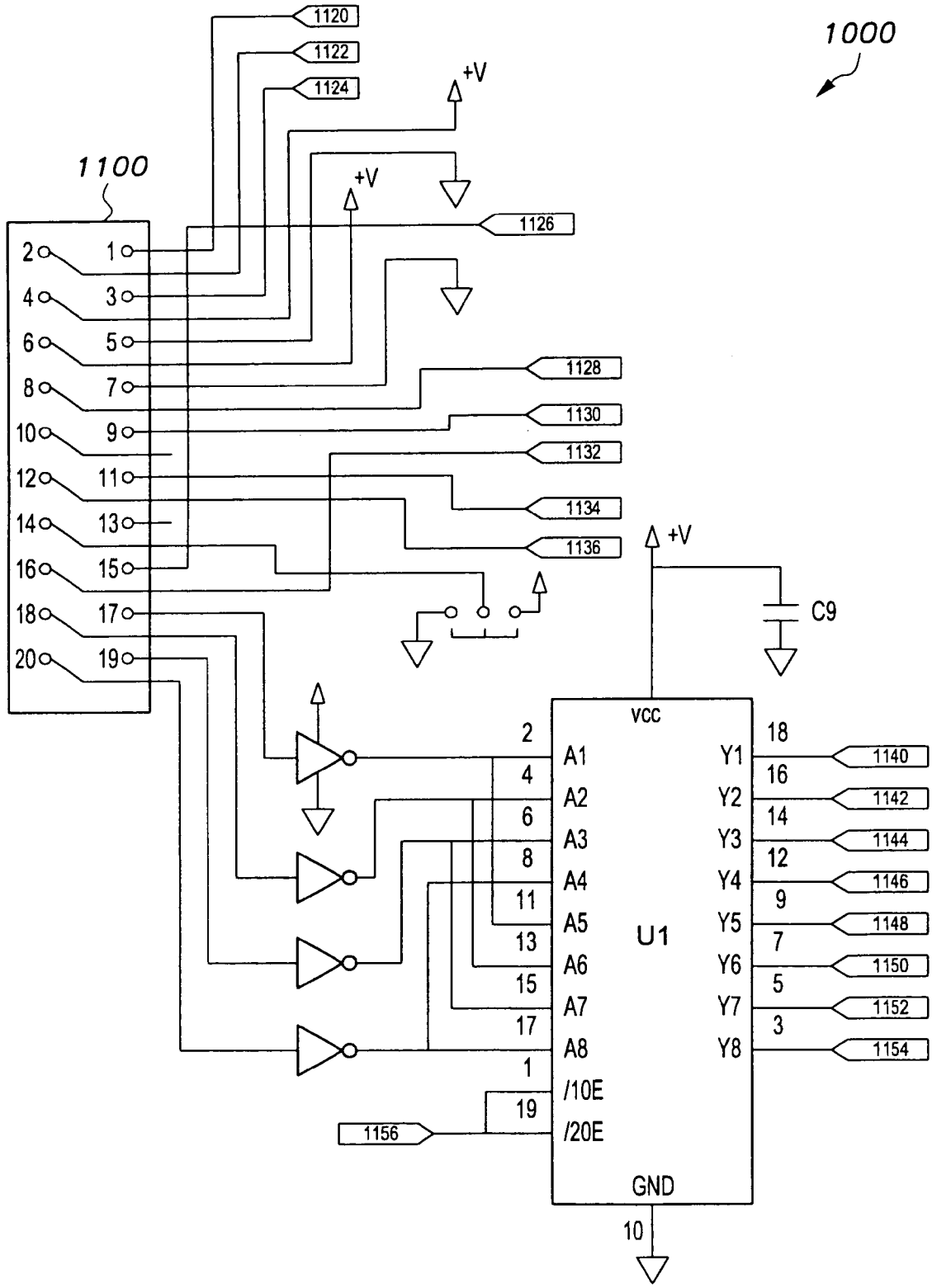
FIGS. 10A, 10B, 10C, and 10D are a schematic diagram of a memory section used to store user defined pickup or switch arrangements in a programmable/semi-programmable pickup and transducer switching system according to the present invention.
Figure 10B:
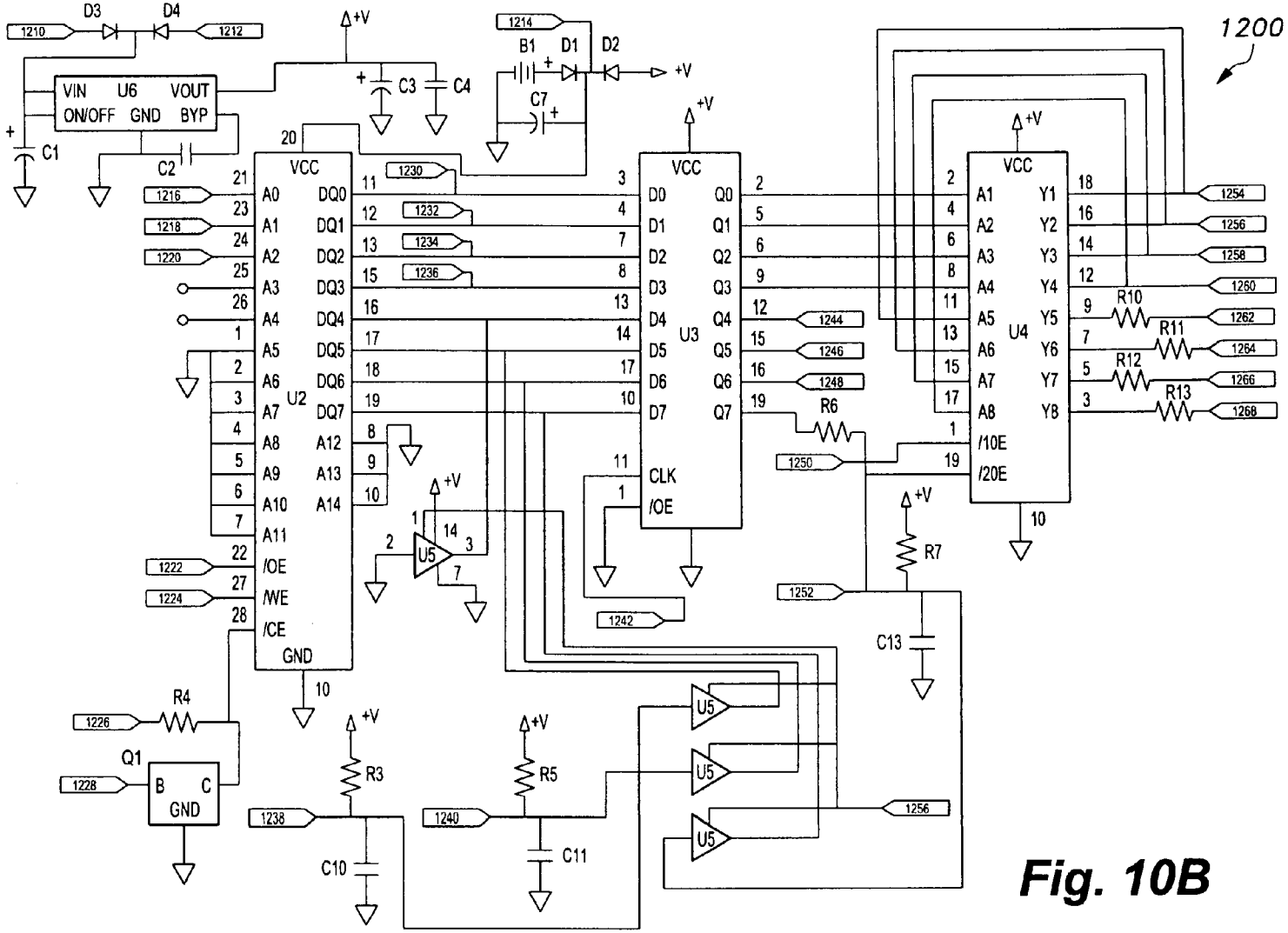
Figure 10C:
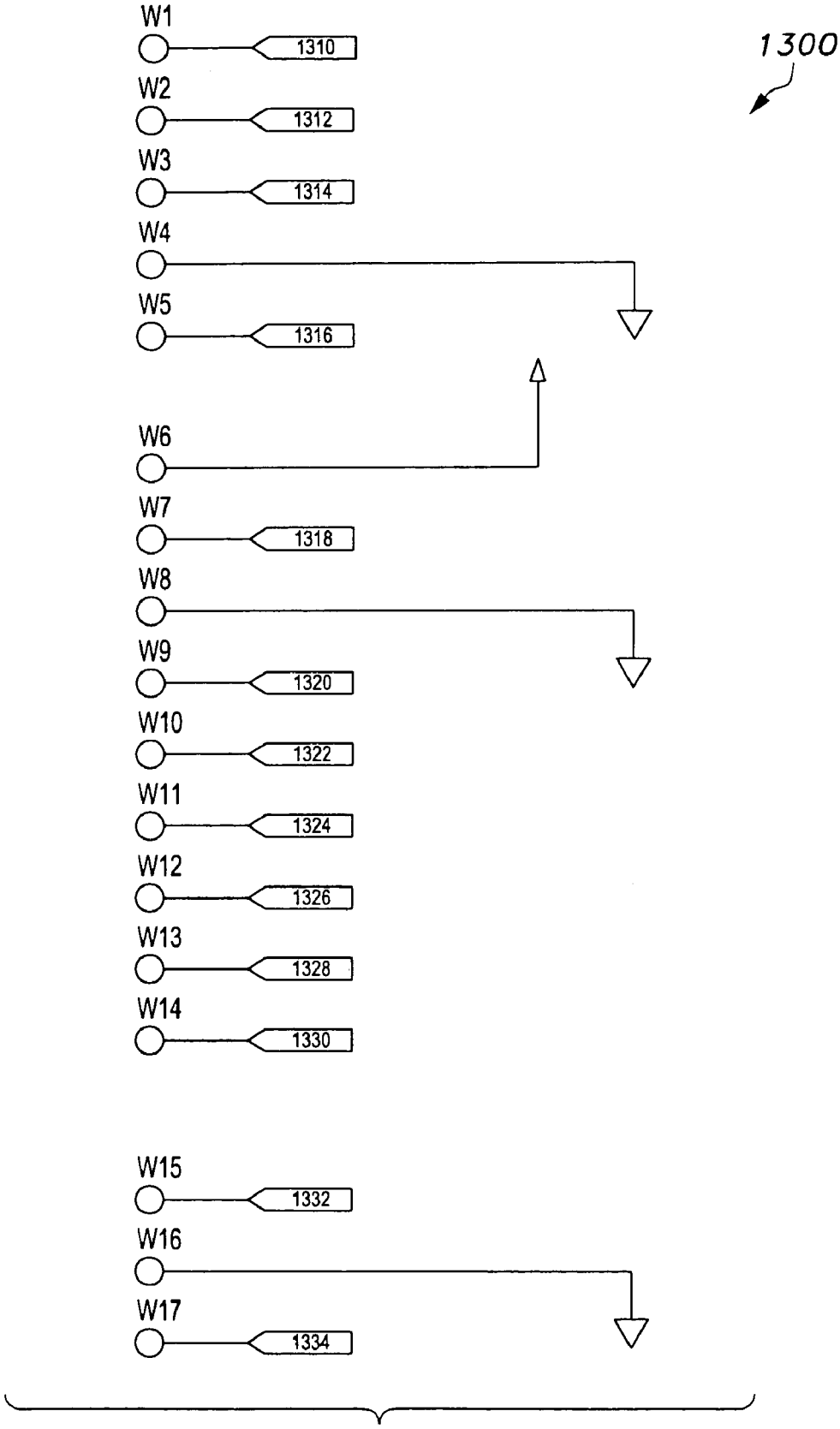
Figure 10D:
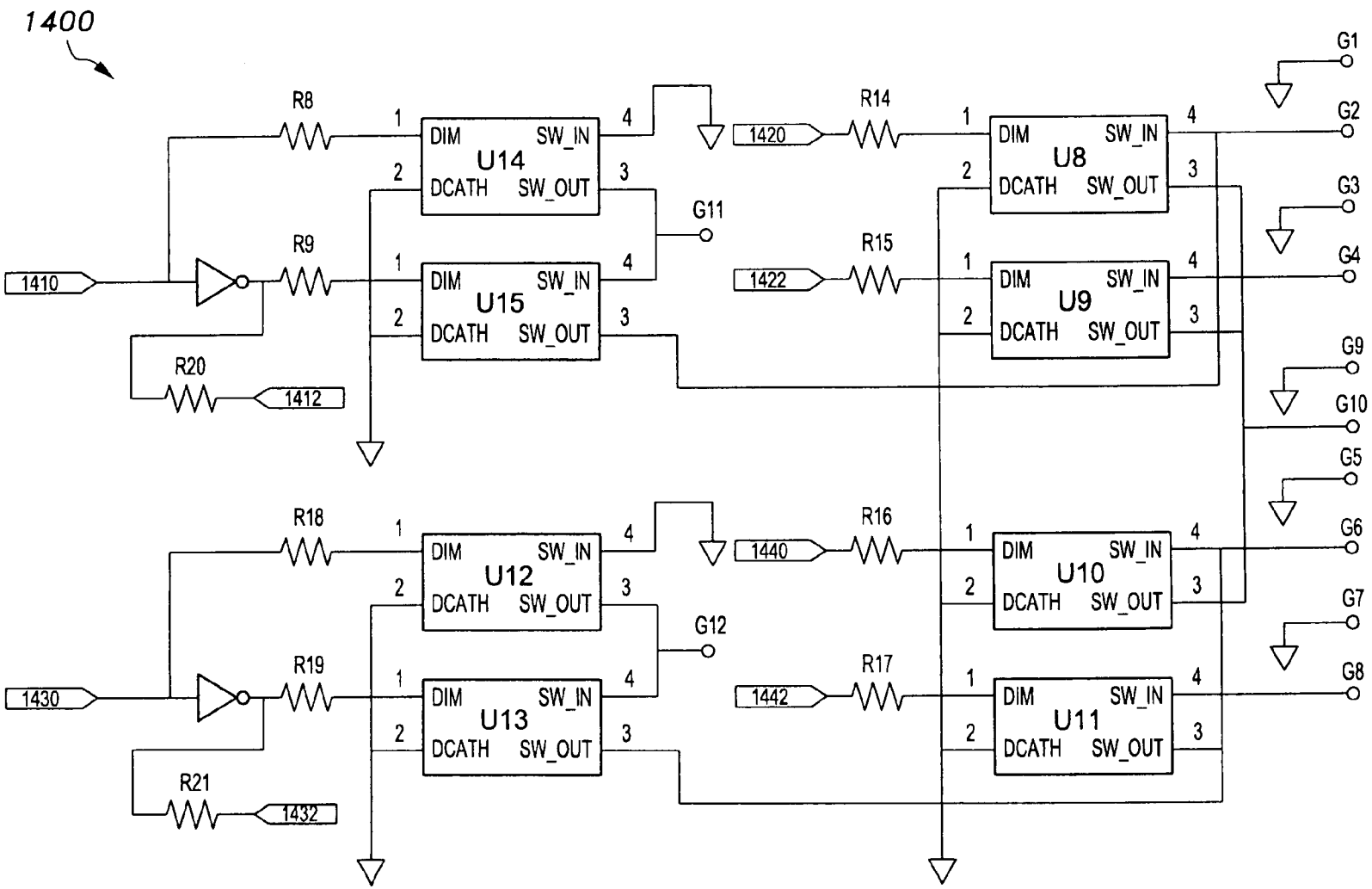
Figure 11:
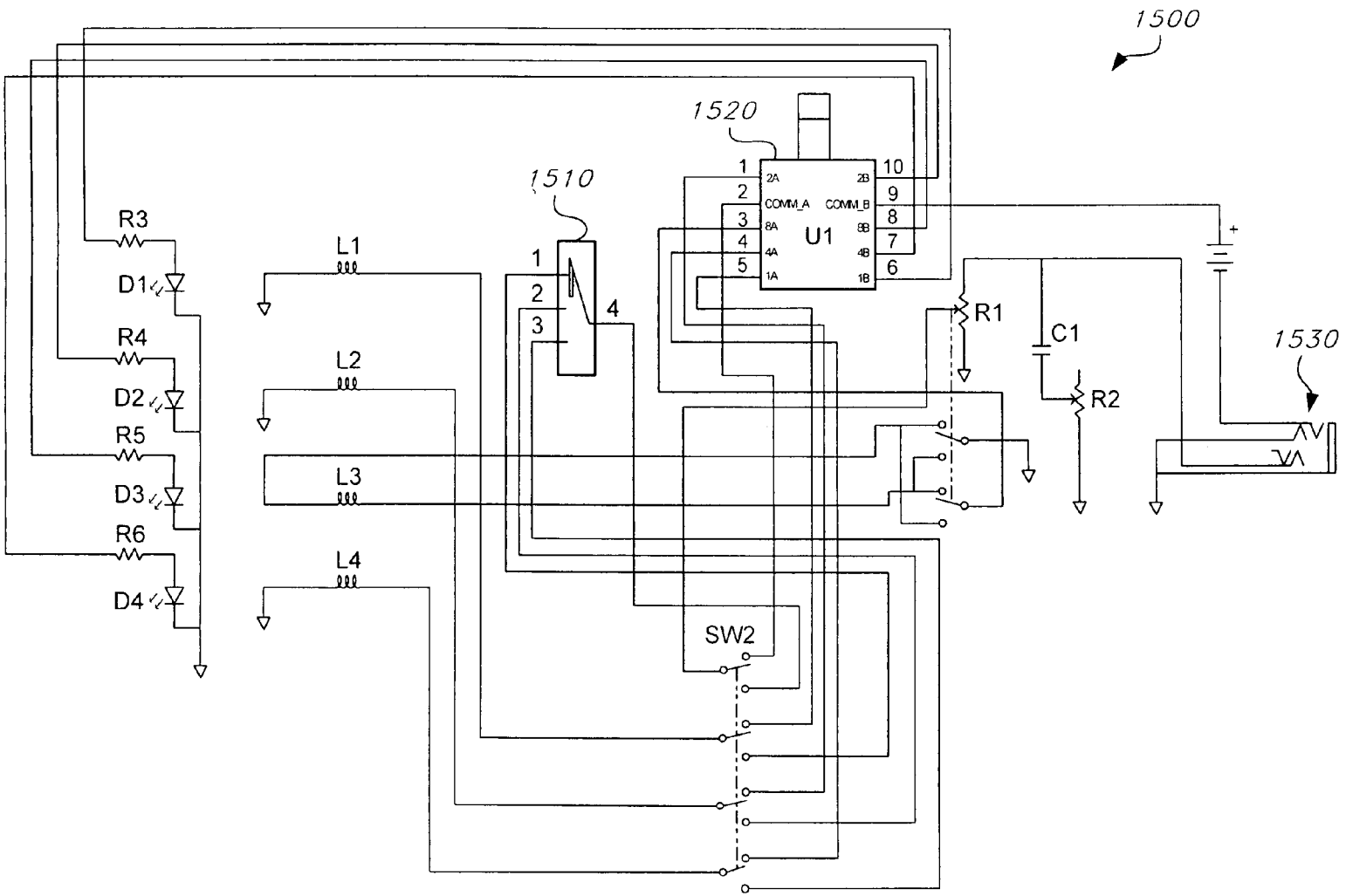
FIG. 11 is a schematic diagram of a semi-programmable 100% passive audio path circuitry with a display function for use in the minimal configuration of the programmable/semi-programmable pickup and transducer switching system according to the present invention.
Figure 12:
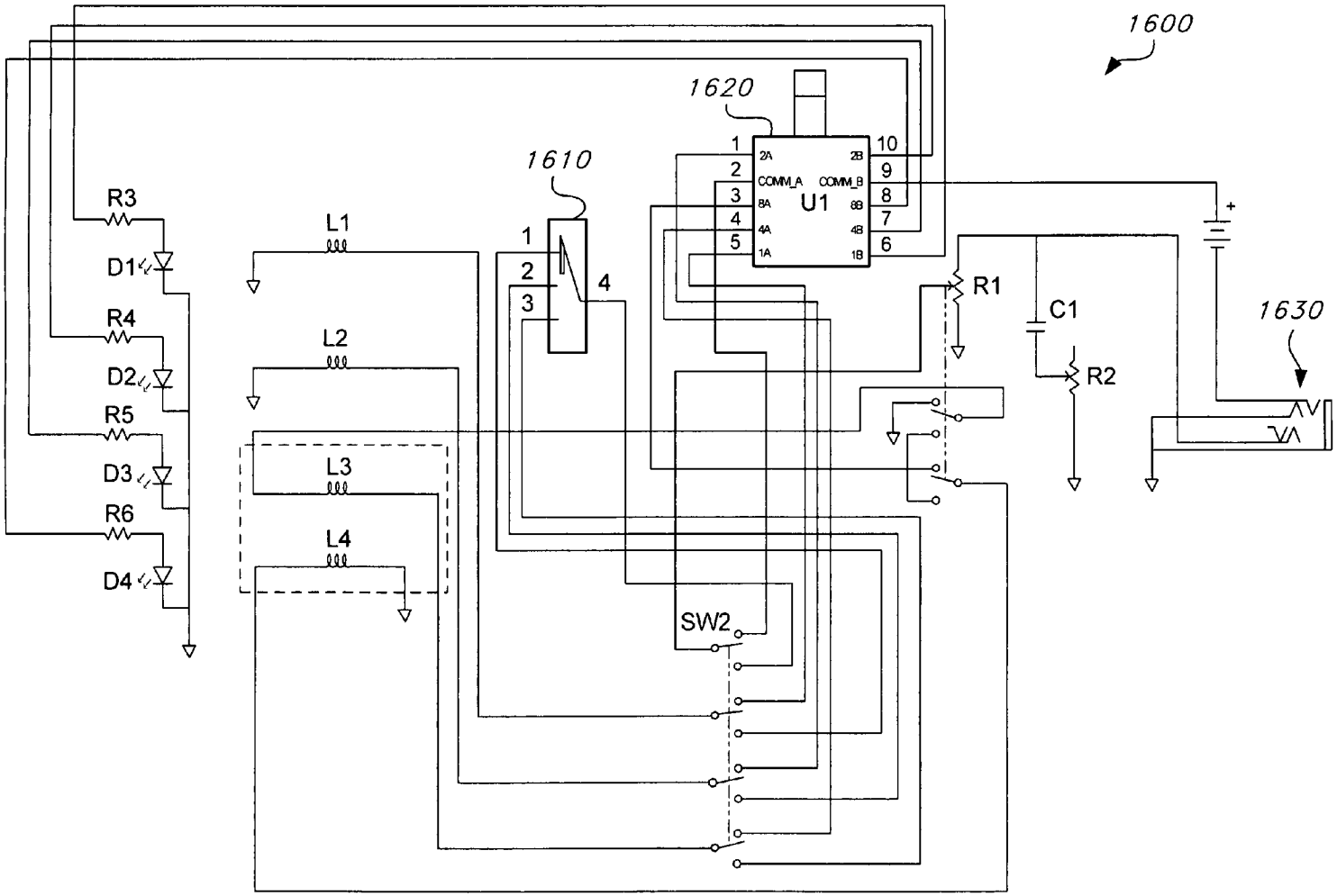
FIG. 12 is a schematic diagram of a semi-programmable 100% passive audio path circuitry with a display function for use in the minimal configuration of the circuitry for use with a programmable/semi-programmable pickup and transducer switching system according to the present invention.

FIGS. 9A, 9B, and 9C show schematic diagrams 900, 910, and 940, respectively, of a clocking circuit used to time and program RAM in the programmable/semi-programmable pickup and transducer switching system 10. FIGS. 10A, 10B, 10C, and 10D show schematic diagrams 1000, 1200, 1300, and 1400, respectively, of a memory section used to store user defined pickup or switch arrangements in the programmable/semi-programmable pickup and transducer switching system 10. FIG. 11 shows a schematic diagram 1500 of a semi-programmable with 100% passive audio path circuitry and display function for use with the pickup and transducer switching system 10. FIG. 12 shows a schematic diagram 1600 of a semi-programmable 100% passive audio path and display function circuitry for use with the pickup and transducer switching system 10.

Figure 13:
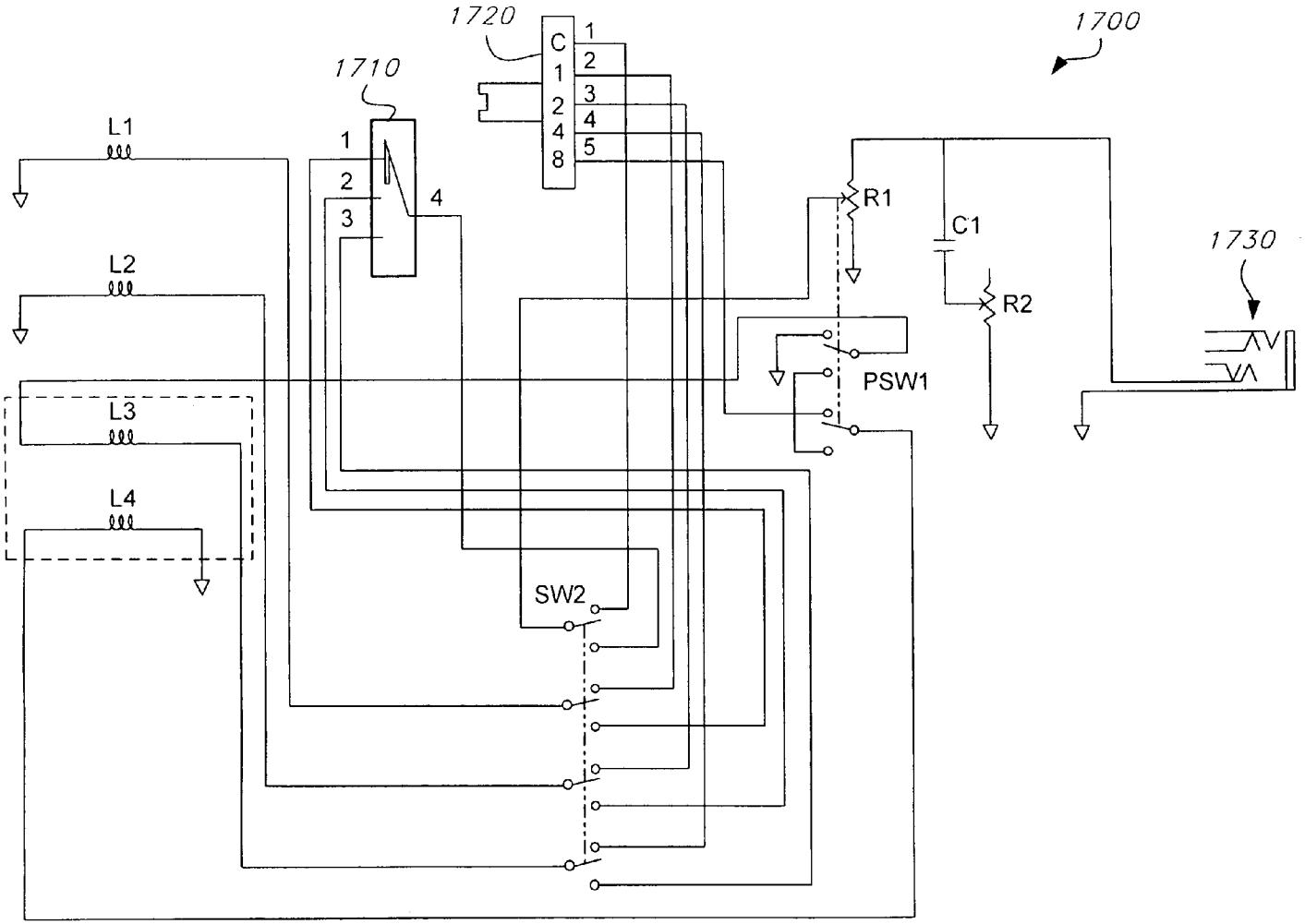
FIG. 13 is a schematic diagram of a semi-programmable 100% passive audio path circuitry without a display function for use in the minimal configuration of the programmable/semi-programmable pickup and transducer switching system according to the present invention.
Figure 14:
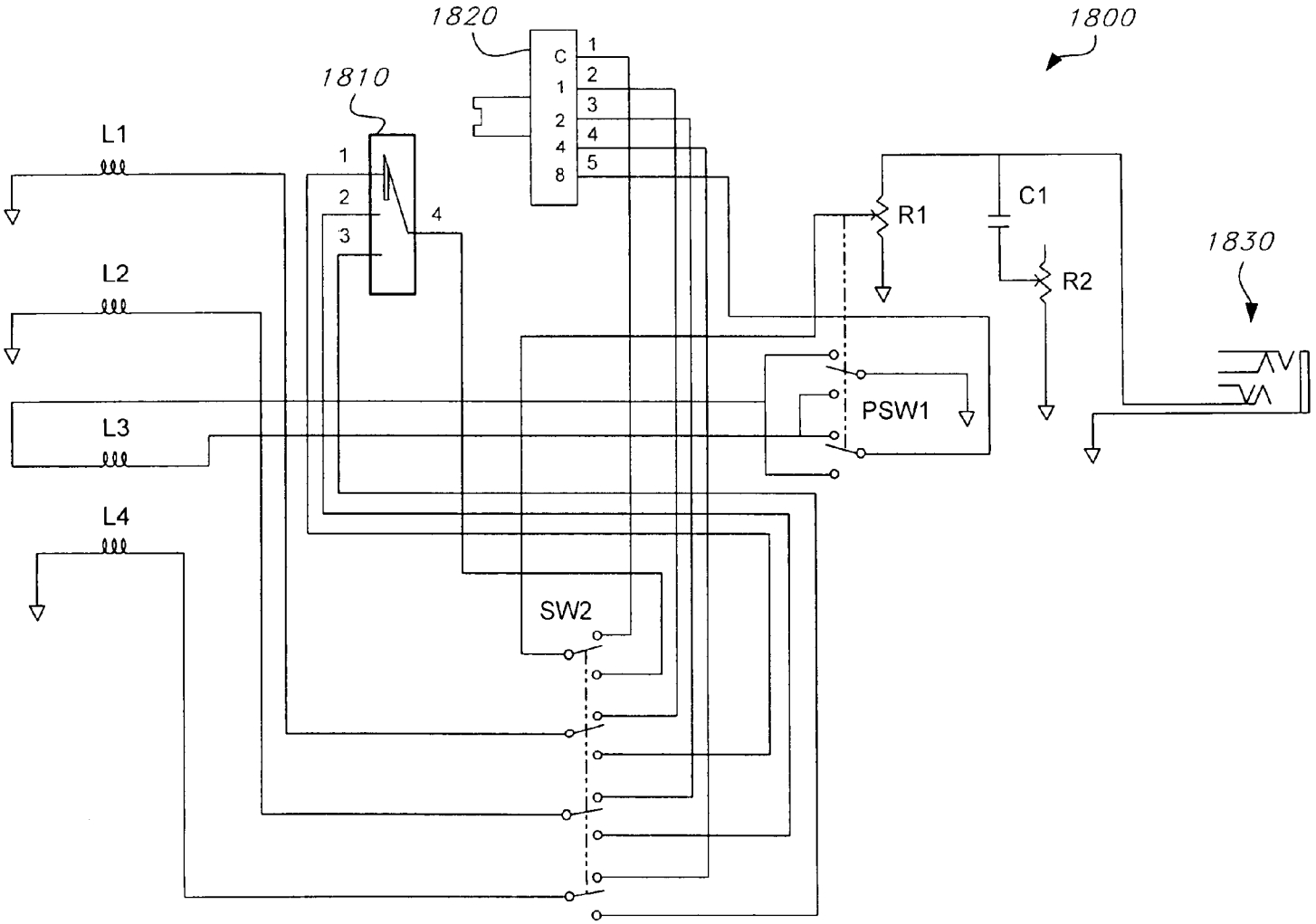
FIG. 14 is a schematic diagram of a semi-programmable 100% passive audio path circuitry without a display function for use in the minimal configuration of the programmable/semi-programmable pickup and transducer switching system according to the present invention.

FIG. 13 shows a schematic diagram 1700 of a semi-programmable 100% passive audio path circuitry without display functions for use with the pickup and transducer switching system 10. FIG. 14 shows a schematic diagram 1800 of a semi-programmable 100% passive audio path circuitry without display functions for use with the pickup and transducer switching system 10.

Figure 15:
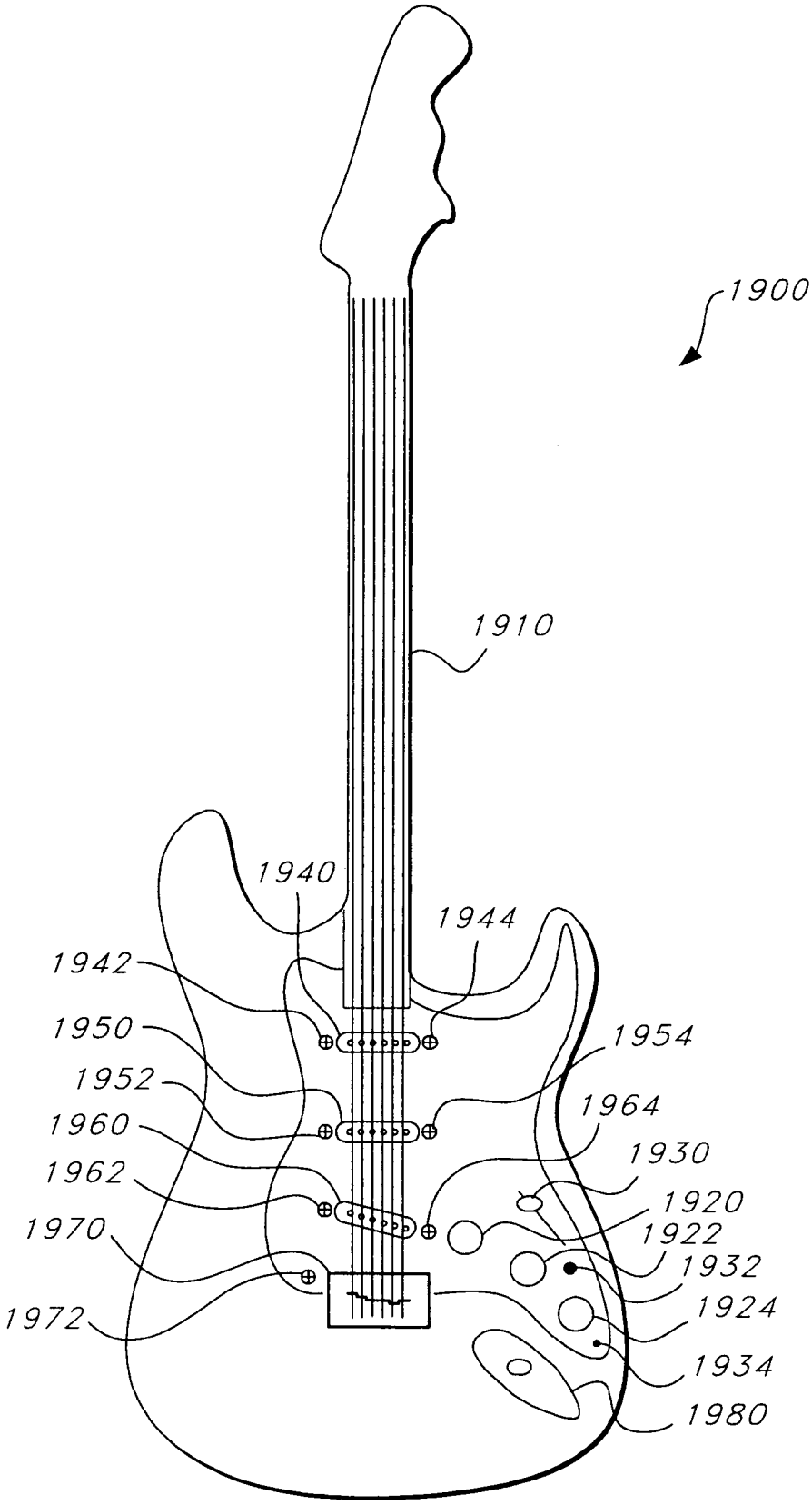
FIG. 15 is a front view pickup and transducer configuration of a six-string guitar equipped with a programmable/semi-programmable pickup and transducer switching system according to the present invention.

FIG. 15 shows a six-string guitar 1900 with a body with a neck 1910. The guitar 1900 is configured with the programmable/semi-programmable pickup and transducer system 10. Specifically, a single pickup transducer or six individually pickup transducers are mounted into the bridge saddle 1970 and mounted on the guitar 1900. The guitar 1900 includes a volume control knob 1920, tone control knob 1922, and a rotary encoder 1924, as well as a five position blade switch 1930, a three position BANK selector switch 1932, and a save/store push button 1934. An upper neck pickup 1940 is attached to the guitar 1900 by a transparent fastening screw 1942 and a standard adjustment screw 1944.

An LED having any desired color is mounted below the transparent fastening screw 1942 and, when illuminated, provides a single coil mode indication for the pickup 1940. A mid position pickup 1950 is attached to the guitar 1900 by a transparent fastening screw 1952 and a standard adjustment screw 1954. An LED having any desired color is mounted below the transparent fastening screw 1952 and, when illuminated, provides a single coil mode indication for the pickup 1950.

A lower position pickup 1960 is attached to the guitar 1900 by a transparent fastening screw 1962 and a standard adjustment screw 1964. An LED having any desired color is mounted below the transparent fastening screw 1962 and, when illuminated, provides a single coil mode indication for the pickup 1960. The piezo transducer bridge saddle pickup 1970 is attached to the guitar 1900 by standard fastening screws in the usual manner. A transparent screw 1972 is provided and located next to the piezo bridge saddle and, when illuminated, provides a piezo pickup saddle transducer mode indication for the piezo pickup 1970. The guitar 1900 provides output signal via output port 1980.

Figure 18:
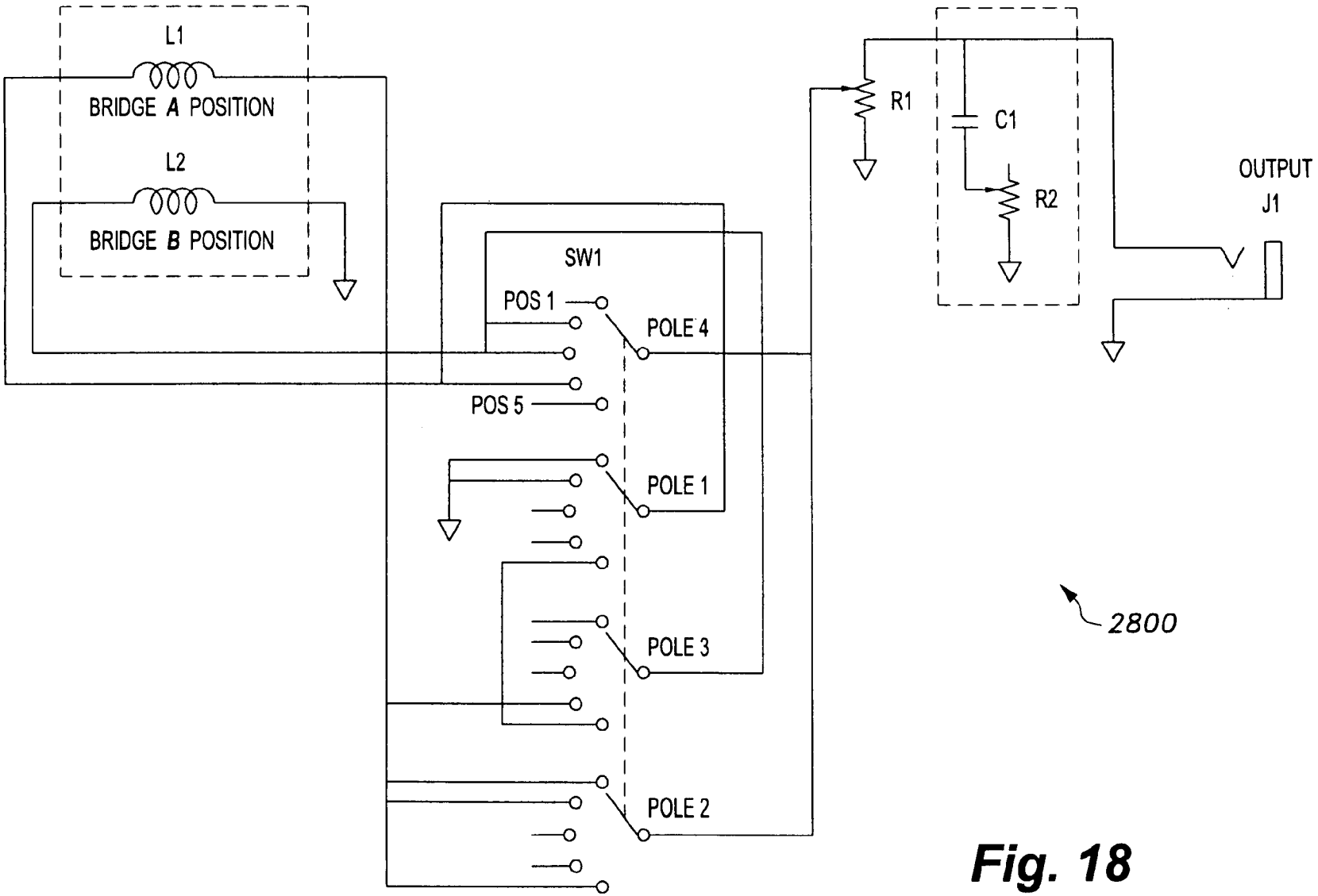
FIG. 18 is a schematic diagram of a semi-programmable 100% passive audio path circuitry without a display function for use in the minimal configuration of the programmable/semi-programmable pickup and transducer switching system wherein the control is a single five position blade switch passively wired to a single four wire pickup with shield, volume control and optional tone control for selection of three single coil tonalities, one out-of-phase tonality and one humbucking tonality of passive audio pickup switching according to the present invention.
Figure 19:
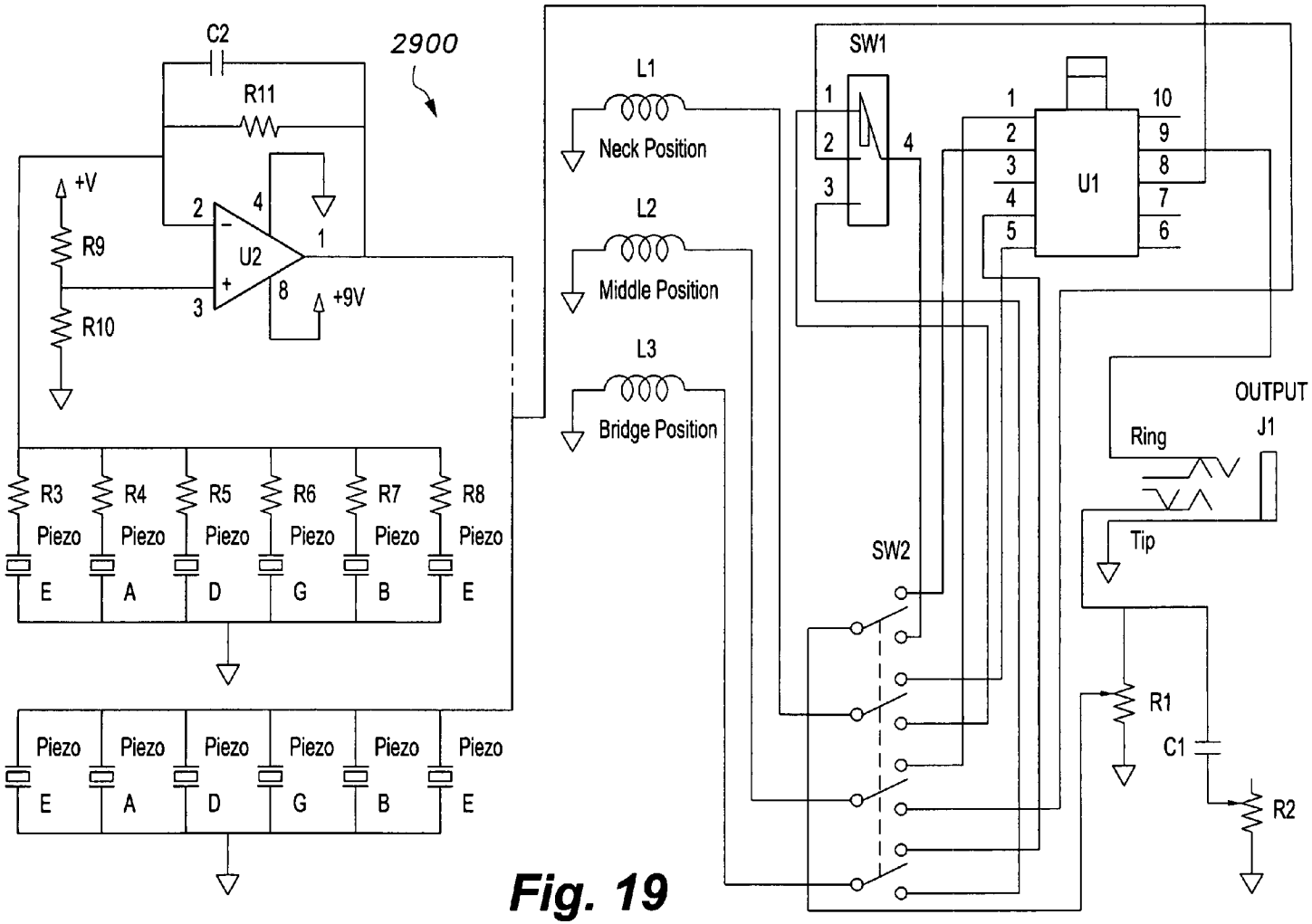
FIG. 19 is a schematic diagram of a semi-programmable 100% passive audio path circuitry without a display function with active summing options for use in the minimal configuration of the programmable/semi-programmable pickup and transducer switching system according to the present invention.

FIG. 16 shows a view 2000 illustrating a chart 2100 of fifteen single coil sounds to select from using the programmable/semi-programmable pickup and transducer switching system 10, and a chart 2200 illustrating additional sounds to select from with four humbucking sounds to mix with the single coil sounds. FIG. 17 shows a view 2400 illustrating a chart 2500 of fifteen single coil sounds to select from using the programmable/semi-programmable pickup and transducer switching system 10, and a chart 2600 illustrating seven additional out of phase sounds to select from. FIG. 18 shows a schematic diagram 2800 of a semi-programmable with 100% passive audio path circuitry wherein the control is a single five position blade switch passively wired to a single four wire pickup with shield, volume control and optional tone control for selection of three single coil tonalities, one out-of-phase tonality and one humbucking tonality of passive audio pickup switching without a display function for use with the pickup and transducer switching system 10. FIG. 19 shows a schematic diagram 2900 of a semi-programmable with 100% passive audio path circuitry with active summing options without a display function for use with the pickup and transducer switching system 10.

Figure 20:
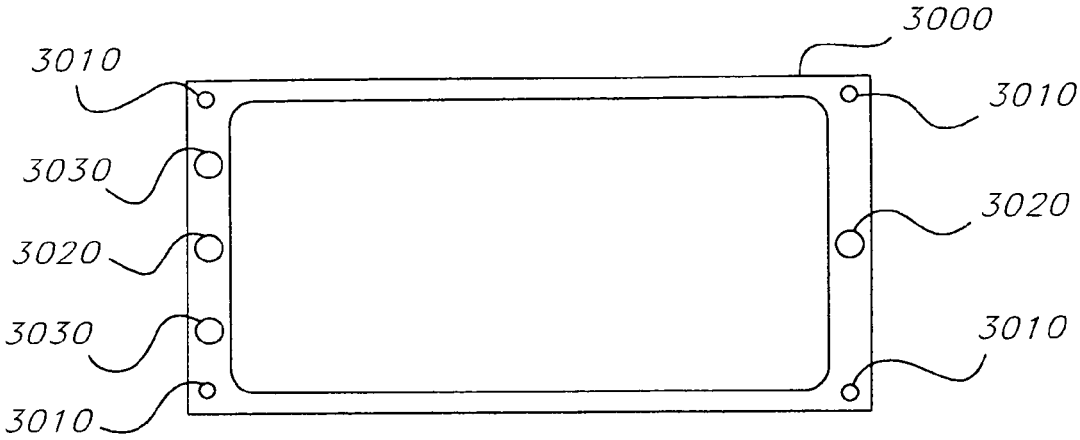
FIG. 20 is a front view of a pickup retaining ring for use with the programmable/semi-programmable pickup and transducer switching system according to the present invention.

FIG. 20 is a front view of a pickup retaining ring 3000 for use with the programmable/semi-programmable pickup and transducer switching system 10. The pickup retaining ring 3000 includes a plurality of apertures 3010 for fastening the pickup retaining ring 3000 to a guitar, magnetic pickup mounting and height adjustment apertures 3020 for transparent screw and light indicators (e.g., when humbucking mode is on), and apertures 3030 for transparent screws and light indicators (e.g. when single coil mode is on).

Figure 21:
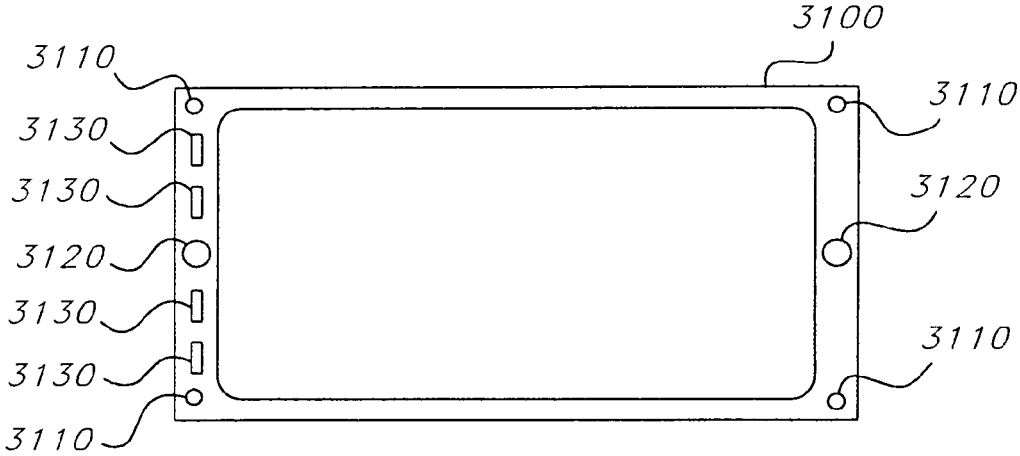
FIG. 21 is a front view of a pickup retaining ring for use with the programmable/semi-programmable pickup and transducer switching system according to the present invention.

FIG. 21 is a front view of a pickup retaining ring 3100 for use with the programmable/semi-programmable pickup and transducer switching system 10. The pickup retaining ring 3100 includes a plurality of apertures 3110 for fastening the pickup retaining ring 3100 to a guitar, magnetic pickup mounting and height adjustment apertures 3120, and apertures 3130 for light indicators mounted on either end of the pickup retaining ring 3100 for indicating system status.

Figure 22:
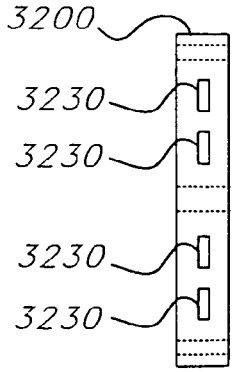
FIG. 22 is a side view of a pickup retaining ring for use with the programmable/semi-programmable pickup and transducer switching system according to the present invention.

FIG. 22 is a side view of a pickup retaining ring 3200 for use with the programmable/semi-programmable pickup and transducer switching system 10. The pickup retaining ring 3200 includes apertures 3230 for light indicators mounted on either side of the pickup retaining ring 3200 for indicating system status.

FIG. 23 illustrates an alternative lighting and display system 3300 which includes five display LEDs 3302, 3304, 3306, 3308 and 3310, located adjacent to and parallel with the five position blade switch 3012, from below the pickguard or wood on the PCB board itself, for ease of installation and the elimination of any requirement for transparent hardware. By way of example only, LEDs 3302, 3308 and 3310 are shown in a lighted condition, while LEDs 3304 and 3306 are off. Of course, the number of LEDs could be greater or fewer as could the individual colors of the LEDs, related to the number and type of pickups on the intrument.

As described above, due to the great number of programmable pickup combinations and configurations, the indication or display system 70 visually indicates the pickups' on/off status and system status. This display system is done in an elegant manner, and isnon-intrusive to the instrument's natural look and appearance. By replacing the standard fastening screws used to hold the pickup element(s) in place on an instrument with transparent screws, the screws continue to function in the usual functional manner but now also take on the new function of allowing light from LED's under the screw to shine through indicating the on or off status of each particular pickup and are not just decorative in nature. The screws continue to fasten the pickup to the instrument, provide a means in which to adjust the pickup height relative to the string as is common place, but now also provide an indication of which pickups are ON or OFF by lighting up in different colors or by lighting ON and shining through the transparent screw for a pickup which is on or not shining through the transparent screw for a pickup which is OFF.

A passive form of the programmable pickup and transducer switching system 10 can be used with the same basic elements described above with exception that no full programmability is offered and the active switching elements are replaced with plated contacts within the rotary encoder element itself, to configure the system 10 to function in a mode very similar in nature to the original state of functionality of type STRATOCASTER but with added semi-programmability of one instant access or program presetting of any of the sounds defined in FIGS. 16 and 17 or specific to the particular pickup configuration of an instrument.

In this form the three position switch with increased poles can remain a three position switch or become a two position switch and provide a bypass or normal STRATOCASTER switching or original guitar wiring switching schemes common in the arts but when set to the other position, enables the encoder to passively switch the pickup elements allowing the musician one preset of chosen choice from the sixteen or thirty-two position encoder to have instant access to. This function also enables a musician to compare the original STRATOCASTER selections or original guitar wiring and sounds to that of the new combinations offered by the system 10 for reference. While the switch is set for encoder operation, the musician can just rotate the encoder as before and make selections of choice in this manner. Using the original five position switch requires that the three position or two position switch be returned to the opposite setting to re-enable the main five position switch hard wired for any original operation.

As described above, the programmable/semi-programmable pickup transducer switching and selection system 10 includes a five position switch attached to a control logic PCB, a rotary encoder control with a four or five bit output connected to the control logic PCB, a plurality of pickups/transducers connected to memory/switch/selector PCB, a micro-sized SAVE button for saving selections to memory, a display using LED's with transparent screws for indication of selections under the rotary encoder control element standing alone in the semi-programmable version of system 10 or accessed from memory and additional BANK select switch of three to five positions serves as an entire system for selecting and controlling the many different sounds a plurality of pickups and/or transducers provide within a given musical instrument.

As is the case with many existing switching methods, providing full Boolean combinations with respect to the number of coils populated on the instrument of selected pickup sounds is not commonplace. This system 10 not only provides full Boolean combinations of the quantity of pickup and transducer sounds, it allows for instant or pseudo random access of these pickup configurations in programmable and semi-programmable manners where by the settings are remembered even after the application of power is removed or if the battery life is exceeded. Furthermore, the system 10 does this without the aid of microprocessors, microcontrollers, or field programmable gate array's allowing for low noise operation with very efficient power consumption.

The system 10 is designed to be easily operated during a real time performance and user friendly to a musician by using similar switches for which the performer is already familiar. The system 10 can be used in one of two ways. The system 1 0 can simply select the many different pickup combinations of three or four or five pickups, by the musician rotating the rotary encoder control. This process can be repeated over and over again by the continuous rotation of the rotary encoder control.

The other way to use the system 10 is to place the five position blade switch to a preferred position, rotate the encoder control until a desired sound or pickup selection is achieved, then press the micro-sized push button to SAVE that particular setting to memory for recall at a later time. The next time the five position switch is returned to this same preferred position, the setting is remembered for instant recall. This process can be repeated for each of the five positions offered by the familiar five position blade switch common in the arts. Additional BANKS of five position locations can be achieved by moving a three position switch from it's UP position to its next position (center) thereby providing five new locations for access of pickup selections made by turning the encoder control. Now the three position switch can then be placed in its DOWN position allowing five more selections to be made and stored to memory for access during a performance. This achieves fifteen locations to store the different pickup sounds and configurations. Twenty-five locations can be achieved by replacing the three position switch with an additional five position switch.

In this example of four pickups or three pickups with a transducer, a total of sixteen different tonalities can be made including all pickups OFF (no sound/silent mode) of which fifteen of the selected ON combinations can be accessed from memory using the five position switch in conjunction with the three position switch, UP, CENTER and DOWN positions. The three position switch is the multiplier and the five position switch is the main digit selection, three times five equals fifteen user programmable selections. By using another five position switch in place of the three position switch, five times five for a total of twenty-five user programmable selections can be made from thirty-two sounds achieved from an instrument having five pickups (five available coils). There are yet additional tonalities achieved by providing a potentiometer/switch control for either the master volume or tone or both master volume and tone controls allowing a humbucking pickup to be used in humbucking mode as well as single coil modes or by placing (wiring) one of the single coil pickups 1800 out of phase with the rest of the pickups in a system. Different tonalities can be achieved according to the transfer functions relevant to the number of pickups and pickup configurations provided on a given instrument.

For example, variations for three magnetic pickups are as follows:

$2^3-1=7$ different tonalities not including all pickups off.

$2^3-1+2^21=10$ different tonalities not including all pickups off but with one phase reversal switch position of the middle single coil pickup.

Variations for four magnetic single coil pickups are as follows:

$2^4-1=15$ different tonalities not including all pickups off;

$2^4-1+2^3-1=22$ different tonalities not including all pickups off but with one phase reversal switch of the 3rd position single coil pickup; and $2^4-1+2^2=19$ different tonalities not including all pickups off but with one humbucking switch of the $3^{rd}$ position dual single coil/humbucking pickup.

Variations for five magnetic pickups with two (4 wire+shield) humbucking type pickups plus one single coil pickup are as follows:

$2^5-1+2^2-1+2^2-1=37$ different tonalities not including all pickups off but with either of or both of the two humbucking pickups in the $1^{st}$ or $3^{rd}$ position switched from dual single coil to a humbucking mode of pickup operation.

The same transfer functions apply to the same number of total pickups but with a mixture of magnetic pickups and bridge transducer type pickups for an acoustic type sound found common in the arts of acoustic guitar pickups and the blending of the pickups with magnetic type pickups.

The simpler passive and semi-programmable forms of the programmable/semi-programmable pickup and transducer switching system 10 using the same basic elements described above with exception that no full programmability is offered and the active switching element is replaced with plated contacts within the encoder element itself, provide the musician with a means to compare the original pickup selections of the instrument with the new multi-selections of the encoder. The three position switch becomes the bypass switch allowing normal use of the main five position switch when in the down position and selects the encoder rotation pickup selection when in the up position. The display system can be entirely omitted requiring no batteries or remote power for pickup switching operation. If the display is desired for ear training of the new pickup settings, then this is the only sub-system requiring power to light the LED's corresponding to the encoder selections.

The system 10 can accommodate out of phase, series humbucking and/or individual single coil pickups by using the same control manner selection musicians have used for many years, that being the use of a single five-way (five position) blade switch. Minimal additional controls need be added to the existing or new guitar instrument of STRATOCASTER or other type.

Due to the many other styles of electrified musical instruments on the market, the applicability is the same except that implementation and locations of this invention's control methods may be accommodated with even greater ease because of not having to fit into a particular form factor such as the type STRATOCASTER guitar.

Because the additional amount of pickup combinations may be difficult to remember to the performing musician, all kinds of display methods have been used such as LCD Displays, DOT Matrix type displays and other bulky displays. In the case of this invention, an elegant method of displaying which pickups are selected is provided for. In this unique approach, transparent screws are used in place of the standard screws for fastening the pickups to the instrument. The screws are functional in three ways: (1) fastening the pickups to the instrument for placement; (2) adjusting the high of the pickup relative to the strings of the instrument for amplitude or output level adjustment; and (3) providing transparency such that an LED from beneath the screw indicates weather a particular pickup is selected or not by the LED being on or off or indicated by a difference in color.

Additionally, these transparent screws provide a port access for other LED's to be used such as IR LED's or other digital signal receiver and transmitter LED's. This type of data exchange LED's in conjunction with the access port can be used for the exchange of pre-programmed selection data of pickups for storage. The access port can also output to an IR MIDI controller to make the five-position blade switch send MIDI commands to an external IR MIDI device. The transparent screws access port can also be used for inputting or outputting Digital Signal Processing (DSP) sound modifying effects data or selection such as built in reverbs, delays, distortions, echoes and other DSP related sound effects within the instrument itself.

An infrared or IR LED receiver within the guitar and a transmitter device located on the floor or pedal board accommodates options for remote control switching of the instrument pickups or sound settings by the musician. This would enable hands free operation of pickup/sound selection. This infrared method can be applied to the exchange of data relevant to the control of effects within the instrument.

A pure passive form of the invention exists that uses the same basic elements described above with exception that no programmability is offered and the active switching element is replaced with plated contacts within the encoder element itself. That is, the pickups or transducers under encoder selection actually pass through the encoder as to make contact to the common pole, which is then connected to the instrument's master volume and tone controls final output. No power is required in this form hence purely passive operation. At the discretion of the user, battery power or source power is only required to allow the LED with transparent screws display system to function and to provide status to the musician as to which pickup selections are being made when the encoder is turned from one to sixteen or one to thirty-two positions, again depending on how many pickups are provided on the instrument and in which type of pickup configurations they are arranged.

The programmable pickup and transducer switching system 10 provides a new and useful method for selecting seven to thirty-seven different pickup selections and provides programmability without the use of microprocessors, microcontrollers, field programmable gate array's and other inherently noisy digital means, and is simpler in construction, more universally usable by musicians of all types and more versatile in operation than any known apparatus. Furthermore, the ease of use in the programmable mode of operation, programming the pickups selection and manual mode of operation, a performing musician can adjust while playing the instrument, his/her preferences as they perform live as well as prior to the performance.

Referring to all of the various configurations described above, the transparent screws and associated LEDs can be configured in any color, and can be placed on any side of the associated pickup (e.g., left, right, or both sides), and they can be used whether they are used in a pickup guard plate or no plate at all. Also, the LEDs can also be mounted directly into the pickups and transducers themselves for the indications of which pickups are on or off. The LEDs can also be arranged within the pickup retaining ring that surrounds the pickup or pickups. The display LEDs may also be located by and parallel to the five position blade switch from below the pickguard or wood on the PCB board itself for ease of installation and not require transparent hardware whatsoever. In addition, photo voltaic MOSFETs can be used to act as the switching elements for the magnetic pickups and/or piezo type transducers. The photo voltaic MOSFETs can be mounted directly into the pickups and transducers themselves for switching the sounds on and off. In addition, linear photo voltaic MOSFETs can be used to control the amplitude (output level) or frequency (tone) of each pickup or piezo element inside the instrument or instruments pickups. Active op-amps can be used to actively sum different combinations from the encoder element to achieve programmable and semi-programmable sound blending with the same ease of use given in system 10.

The controls involved in both the programmable and/or semi-programmable configurations of the programmable pickup and transducer switching system 10 can be ergonomically configured in accordance with the desires of the user. Pickups and/or transducers can be associated with any position of a five position or multi-position blade switch, or a three positions blade switch or a "Gibson" style three position switch according to the desires of the user.

Musical instruments can be configured with a passive mechanical rotary encoder for the Boolean or binary selection of multiple pickups or transducers for the selection of sounds or tones produced. The use of the switching system for control of built in digital signal processing effects such as reverb, chorus, distortion, equalization, or external MIDI control functions can be provided via an assignable MIDI output five position switch.

The programmable/semi-programmable pickup and transducer switching system 10 provides a new programmable/semi-programmable pickup, pickup/transducer sound selecting device that has many novel features not offered by known apparatus that results in a new programmable/semi-programmable, multiple pickup switching and selecting device which is not apparent, obvious, or suggested, either directly or indirectly by any known apparatus.

The programmable/semi-programmable pickup and transducer switching system 10 provides easy selection of multiple pickup or transducer selections not able to be easily selected from before and to provide programmability of a user specified order of selection relevant to a familiar five position control switch that can overcome deficiencies of prior art devices.

The programmable/semi-programmable pickup and transducer switching system 10 provides a programmable pickup and/or transducer selection device that allows manual selection as well as programmable selection of pickup and/or transducer devices for output to an amplifier, recording or broadcasting equipment. The programmable/semi-programmable pickup and transducer switching system 10 provides a programmable pickup and/or transducer selection device that provides programmability of selected pickup choices and their selected order position relative to the main five position switch. The programmable/semi-programmable pickup and transducer switching system 10 provides a programmable/semi-programmable selection device that has a SAVE/STORE switch to allow saving a selected pickup via the encoder to a memory location accessed by the five position switch. The programmable/semi-programmable pickup and transducer switching system 10 provides a programmable/semi-programmable selection device that uses the familiar five position switch to be set to access any preset pickup selection written by the encoder and Save switch.

The programmable/semi-programmable pickup and transducer switching system 10 provides a programmable pickup and/or transducer selection device that provides a BANK selection using a three, five, or eight position switch for additional groups of fifteen, twenty-five and forty pre-programmed pickup/transducer selections. The programmable/semi-programmable pickup and transducer switching system 10 provides a programmable pickup and/or transducer selection device that provides a push/pull type switch affixed to the master volume and/or tone controls to select between humbucking or dual single coil modes of operation using standard four wire with shield humbucking type pickups providing a thick, extra fat sound or a single coil clear sounds.

The programmable/semi-programmable pickup and transducer switching system 10 provides a programmable/semi-programmable pickup and/or transducer selection device that provides a push/pull type switch affixed to the master volume and/or tone controls to place a single coil or humbucking type pickup out of phase with the rest of the pickups providing a thin funky type sound. The programmable/semi-programmable pickup and transducer switching system 10 provides a programmable/semi-programmable pickup and/or transducer selection device that displays the selected pickup or transducer setting from the encoder element or from memory through transparent screws that also hold pickups in place to the instrument and are adjustable for string to pickup pole height.

The programmable/semi-programmable pickup and transducer switching system 10 provides a programmable/semi-programmable pickup and/or transducer selection device that displays the selected pickup or transducer setting from the encoder element or from memory through panel mounted LED's located near the pickups above or below, or to either side of the pickups or near the five position blade switch that are being addressed, selected or turned on or off. The programmable/semi-programmable pickup and transducer switching system 10 provides a programmable/semi-programmable pickup and/or transducer selection device that provides a switch to turn on or off the display system to conserve battery life, display only specific user selected pickup status for ear training or not to display particular pickup and transducer selections at all.

The programmable/semi-programmable pickup and transducer switching system 10 provides a programmable/semi-programmable pickup and/or transducer selection device that allows the system to be remotely powered by a power source outside the instrument and bypass the on board battery. The programmable/semi-programmable pickup and transducer switching system 10 provides a programmable/semi-programmable pickup and/or transducer selection device that provides memory that is non-volatile and can retain pre-set data even after the removal of power or if the battery life of a nine volt battery is exceeded.

The programmable/semi-programmable pickup and transducer switching system 10 provides a programmable/semi-programmable pickup and/or transducer selection device that can accommodate a plurality of pickups, pickup configurations and transducers on any given musical instrument. The programmable/semi-programmable pickup and transducer switching system 10 provides a programmable/semi-programmable pickup and/or transducer selection device whose integral five position switch and PCB sub-system installs into existing body cavity of type STRATOCASTER with little or no additional drilling or routing of wood for clearance. The programmable/semi-programmable pickup and transducer switching system 10 provides a programmable/semi-programmable pickup and/or transducer selection device that allows use of IR to remotely control the pickup selections or quickly change the setting from one setting to another to achieve a special effect while the instrument is being played.

The programmable/semi-programmable pickup and transducer switching system 10 provides a pickup or transducer selection device that provides a passive form of pickup selection that only requires the encoder element and a three position switch for the basic and convenient switching of pickups or transducers on an instrument. The programmable/semi-programmable pickup and transducer switching system 10 provides a pickup or transducer selection device that provides a bypass switch to select between a normal manner of pickup selection and the encoder provider selections.

The programmable/semi-programmable pickup and transducer switching system 10 provides a musician friendly pickup and/or transducer device that is also programmable/semi-programmable and displays selections for ear training of all new tonalities that is more universally functional in today's market than prior art devices.

The programmable/semi-programmable pickup and transducer switching system 10 provides programmable and semi-programmable configurations that are real time programmable by the user during a musical performance for the selection of different tonalities, sounds and pickup arrangements not able to be easily selected from on a musical instrument before. By providing a minimal of controls to the instrument, the functionality is user friendly and easy to use in both the programming and playing modes of operation. The programmable/semi-programmable pickup and transducer switching system 10 resides within an instrument and is interchangeable in many cases with existing switching systems common in the arts, thereby providing ease of installation. The system 10 is applicable to a vast number of musical instruments using magnetic and piezo pickups, and can provide inspiration to musicians and performers by allowing them to express a whole new dimension of sounds from within their new or existing instruments with great ease of use.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A programmable/semi-programmable pickup and transducer switching system, comprising:

a control printed circuit board;

a plurality of switches communicatively interconnected to the control printed circuit board, the plurality of switches including a five position blade switch;

an encoder communicatively interconnected to the control printed circuit board;

a memory/buffer/drive with switching element options for passive or active pickup switching, said memory/buffer/drive being communicatively interconnected to the control printed circuit board; and a display system communicatively interconnected to the memory/buffer/drive, the display system including at least one transparent fastening screw with an associated light emitting diode (LED) configured to provide a visual indication of an associated pickup activity.

2. The system according to claim 1, wherein the control printed circuit board is an integral control logic board configured to provide low noise operation and efficient power consumption.

3. The system according to claim 1, wherein the plurality of switches further comprises a push/store switch.

4. The system according to claim 3, wherein the plurality of switches further comprises a three position switch configured for BANK selection in groups of five for selecting fifteen preprogrammed selections of pickup combinations of single coil and humbucking type configurations.

5. The system according to claim 1, in combination with a guitar and at least two pickups, wherein said display system further comprises at least two transparent fastening screws with associated LEDs configured to provide a visual indication of an associated pickup activity or pickup status.

6. The combination according to claim 5, wherein said at least two transparent fastening screws with associated LEDs are configured on any side of the associated pickup, pickup cover or pickup retaining ring.

7. The system according to claim 1, in combination with a guitar and at least two pickups, wherein LEDs are mounted directly into said at least two pickups, pickup covers or pickup retaining rings to provide indications of which pickups are on or off or provide system status.

8. The system according to claim 1, further comprising photo voltaic MOSFETs configured to act as switching elements for magnetic pickups or piezo type transducers.

9. The system according to claim 8, wherein said photo voltaic MOSFETs are mounted directly into pickups or transducers for switching the pickups on and off.

10. The system according to claim 9, further comprising linear photo voltaic MOSFETs to control an amplitude (output level) or frequency (tone) of a pickup or piezo element.

11. The system according to claim 1, in combination with a guitar with a wireless port, said guitar being remotely controllable in a wireless manner through the wireless port.

12. The system according to claim 3, wherein said plurality of switches further comprises a switch configured for normal operation of an instruments original wiring as BYPASS operation for selection of pickups to SEMI-PROGRAMMABLE mode whereby a single selection of multiple selections offered by the encoder provides semi-programmable selections of pickup configurations of single coil and humbucking type configurations.

13. The system according to claim 1, wherein the rotary encoder is an integral rotary encoder control providing passive audio switching of incremental Boolean logic selections of a number of single coil or humbucking pickups and transducers on an instrument.

14. The system according to claim 1, wherein the rotary encoder is an integral ganged rotary encoder control providing passive audio switching of incremental Boolean logic selections of a number of single coil or humbucking pickups and transducers on an instrument on one pole and LED display switching to power a display system indicating pickup on/off and system status on a second pole.

15. The system according to claim 1, wherein the rotary encoder is an integral rotary encoder control providing passive audio switching of Boolean logic selections of single coil or humbucking pickups on one pole and passive/active switching of saddle transducers on a second pole wired to an output jack on tip and ring respectfully.

16. The system according to claim 1, wherein the control printed circuit board includes the five position blade switch passively wired to a single four wire pickup with shield, volume control and optional tone control for selection of three single coil tonalities, one out-of-phase tonality and one humbucking tonality of passive audio pickup switching.

17. The system according to claim 1, in combination with a guitar with four pickups, wherein a center of a first pickup pole is harmonically located for pickup poles under a second octave harmonic of all open strings, placing a center of a second pickup poles under a second fifth harmonic of all open strings, placing the center of a third pickup poles under the third octave harmonic of all open strings and placing a center of a fourth pickup poles an additional half inch from under a third harmonic at the "Low E" string side and a center of the fourth pickup poles an additional eight tenths of an inch from under a third fifth harmonic at the "High E" string side of a slanted fourth pickup.

18. A method of programming a programmable/semi-programmable pickup and transducer, comprising the steps of:

positioning a five position blade switch to a predetermined one of the five positions;

rotating a rotary encoder to audition a plurality of positions corresponding to different pickup combinations in succession;

at each of the successive positions of the rotary encoder, auditioning sound produced by the pickup combination;

pressing a SAVE/STORE switch to memorize a selection when the audition produces a desirable pickup combination in order to save the rotary encoder position in a memory/buffer/driver location corresponding to the predetermined one of the five positions of the five position blade switch;

moving the five position blade switch away from the predetermined one of the five positions of the five position blade switch;

moving the five position switch back to the predetermined one of the five positions of the five position blade switch;

auditioning sound at the predetermined one of the five positions in order to recall the desirable pickup combination; and repeating the previous positioning, rotating, auditioning, pressing, moving and auditioning steps throughout five, fifteen, or twenty-five predetermined positions.

* * * * *